US005658068A

United States Patent [19]

Fritts

[11] Patent Number: 5,658,068

[45] Date of Patent: Aug. 19, 1997

[54] FLUORESCENT BACKLIT DISPLAY

[76] Inventor: Robert W. Fritts, 1575 N. Second Ave., Stillwater, Minn. 55082

[21] Appl. No.: 523,224

[22] Filed: Sep. 5, 1995

[51] Int. Cl.[6] ..... F21S 3/00

[52] U.S. Cl. ..... 362/225; 362/226; 362/240; 362/260

[58] Field of Search ..... 362/226, 97, 225, 362/238, 240, 260, 256

[56] References Cited

U.S. PATENT DOCUMENTS 4,602,448 7/1986 Grove ..... 362/260 X
5,226,724 7/1993 Kanarek ..... 362/226 X

*Primary Examiner*—Stephen F. Husar
*Attorney, Agent, or Firm*—Joseph C. Schwalbach

[57] ABSTRACT

A fluorescent backlit display embodying a rectangular supporting frame, a display panel on the front of the frame, a plurality of equally spaced elongated modular lamp units each having a base member including an elongated tube of triangular cross section which carries a cylindrical fluorescent lamp provided with light leveling masking, two exterior surfaces of each triangular tube are reflective and are joined at a vertex from which they diverge rearwardly to marginal portions located adjacent a rollable nonspecular diffusely reflective rear wall. One end of each modular lamp unit carries an electrical connector, and a frame member carries a cooperable connector into which the first-mentioned connector can be plugged to provide both an electrical connection and a physical supporting connection for the unit, there being a shoulder member at the other end of each unit cooperable with a releasable latch on a frame member opposing the first-mentioned frame member to provide, with said electrical connectors, the sole support for each lamp unit.

47 Claims, 9 Drawing Sheets

FLUORESCENT BACKLIT DISPLAY

BACKGROUND OF THE INVENTION

1. Field of the Invention

This invention relates in general to fluorescent backlit displays and more particularly to such displays which are especially adapted for use in trade shows.

2. Description of the Prior Art

Trade show displays prior to 1970 were primarily custom type, made of wood, metal and plastic in heavy three dimensional form. Light weight portable displays emerged in the 1970s built around aluminum frames and spokes to serve manufacturers who chose to set up their own exhibits to save labor costs. Such displays were often clad with loop fabric to which all manner of graphic sheets were attached with hook type fastener strips. To attract attention, such displays were often fitted with spotlights that flood the graphic surfaces with light and heat.

While the best presentation of any image was known to be backlit lighting through a translucent image, little use of backlit imagery was the practice until recently. Photographic films were too fragile for knockabout trade show use; and traditional light boxes were rigid massive structures. Kodak technical manuals suggested that good back light design (for acceptable light uniformity) required lamps to be positioned behind the graphic film a distance greater than the lamp to lamp separation.

Early forms of larger backlit displays utilized images formed on fabric or plastic sheeting suspended on the front members of a space frame. Lighting was provided by several common one or two lamp fluorescent lamp units suspended on the rear side of the space frame. Space frames were typically 12 to 16 inches deep to provide stability. Image luminance (or brightness) was typically low, i.e., in the 100 foot lambert range.

My U.S. Pat. No. 5,282,117, dated Jan. 25, 1994 discloses an unique lamp masking system that provides extremely uniform display brightness from lamp arrays in which the lamp-to-image distance is substantially less than the lamp-to-lamp distances. With such masking, light boxes only 5 inches deep are now commercially available, providing brightness of the order of 300 foot lamberts in which the brightness variation between lamps is of the order of less than three percent.

Another significant development is the emergence of very large format electronic imaging producing very large color images of quality comparable to or exceeding that of the photographic transparency. In addition, laminating techniques have been introduced for applying strong polycarbonate sheeting to phototransparencies and ink-jet image substrates, enabling them to withstand handling and to be rolled easily for shipment.

SUMMARY OF THE INVENTION

This invention provides a novel fluorescent backlit display construction employing an improved rectangular supporting frame, plug-in lighting modules and rollable graphics as well as diffusely reflective rollable white plastic or fabric back wall means, all of which can be quickly assembled and disassembled by unskilled personnel.

With the foregoing in mind, it is an object of the present invention to provide an improved frame construction and bracing which is characterized by precise dimensional control, and when assembled, maintains its rectangular shape by virtue of corner struts which form rigidifying triangles with the frame members to which they are connected. These struts, on disassembly of the frame, being swingable into a storage position flat against the frame members to which they are pivotally connected.

A further object of the invention is to provide a frame of the aforementioned character wherein spaced female electrical connectors are carried by one frame member, and an opposing frame member has latch means opposite each female connector. A plurality of modular lamp units, each of which has at one end a male electrical connector cooperable with the aforementioned female electrical connector and has, at its opposite end, shoulder means cooperable with the aforementioned latch means. With this arrangement, each of the modular lamp units can be readily placed into and removed from an operative position wherein it is supported on said frame by said electrical connectors and said latch means.

Another object of the invention is to provide modular lamp units and electrical connectors therefor which are polarized to insure that said lamp units can be plugged into the electrical connectors in only the correct operative position thereof wherein the fluorescent lamps carried by said lamp units face forwardly within the frame.

A more specific object of the invention is to provide modular lamp units as aforedescribed, each of which carries an elongated cylindrical fluorescent lamp having light leveling masking means on the portion of the surface thereof facing forwardly within the frame when the modular lamp unit is in its operative position.

Still another object of the invention is to provide a backlit display construction which, when disassembled, can be packed into a single shipping container having a volume less than half the volume occupied by the display when assembled.

A more specific object of the invention is to provide a backlit display incorporating modular lamp units which are elongated and have a shape in end view which is generally triangular. This configuration lends itself to shock-proof type packaging within a retaining cylinder in which said units are enclosed within protectors formed of flexible resilient plastic sheet material.

Another object of the invention is to provide a backlit display as aforedescribed wherein the shipping container therefor is cylindrical, and the aforementioned retaining cylinder forms a core disposed coaxially within said shipping container, the rollable sheet components of the display are placed in the container in overlaying relation with the inner surface of the shipping container, and the frame members are accommodated in the annular space between the core cylinder and the rollable elements within the shipping container.

A more specific object of the invention is to provide a backlit display as aforedescribed wherein the diffusively reflective back wall thereof, in one form of the invention, is formed of a single rectangular extent of film or fabric overlaying the rear surfaces of the modular lamp units and having marginal portions in registration with and connected to the backside of the frame; and in another form of the invention comprises a plurality of elongated rectangular panels extending between adjacent modular lamp units.

Other and further objects and advantages of the invention will appear to those skilled in the art as the description proceeds, reference being had to the accompanying drawings.

BRIEF DESCRIPTION OF THE DRAWINGS

In the drawings accompanying and forming part of this application.

DESCRIPTION OF THE PREFERRED EMBODIMENTS

Figure 1:
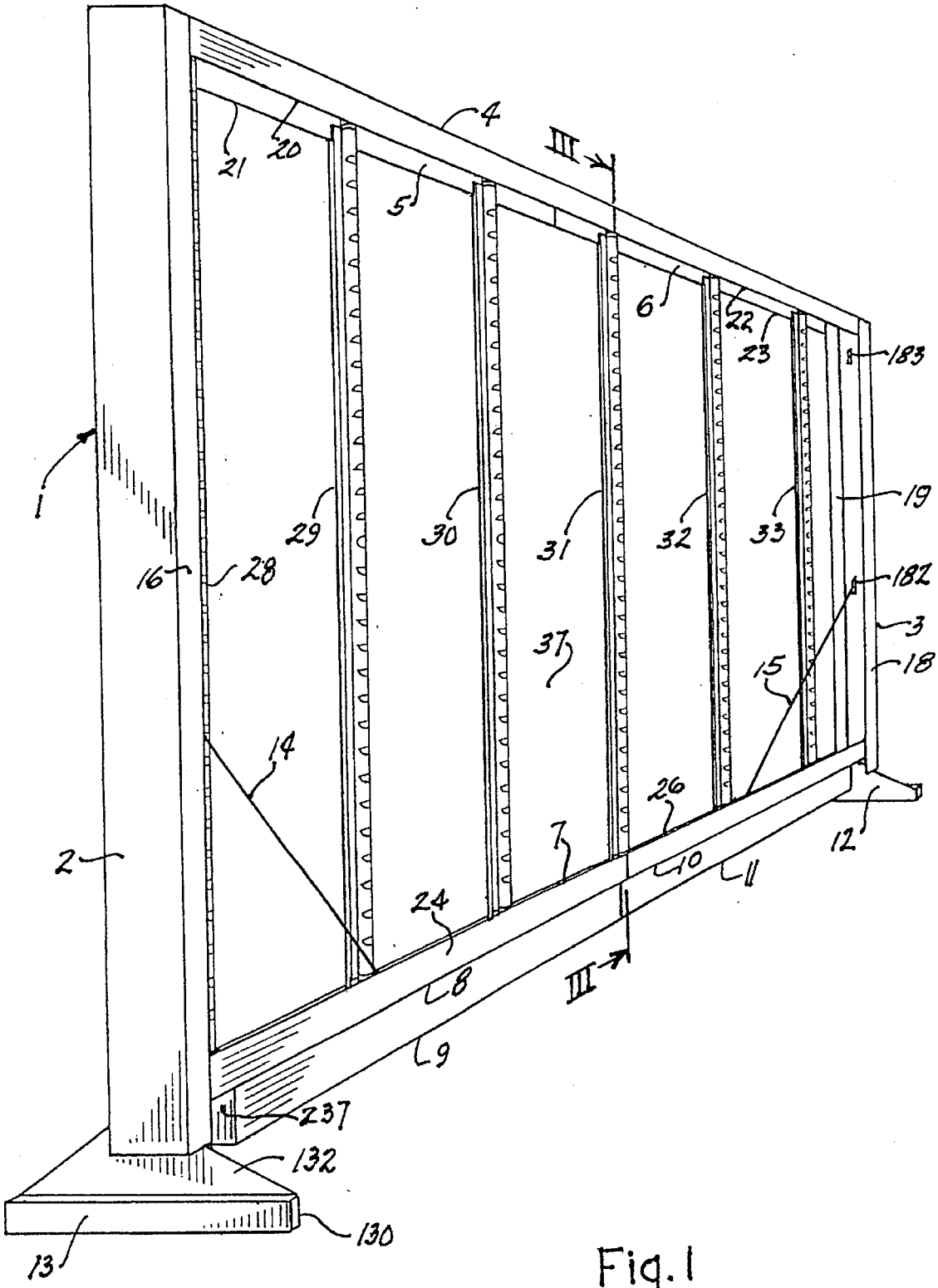
FIG. 1 is a front perspective view of one form of the improved backlit display of the present invention, the display panel thereof being removed to illustrate the internal structure.
Figure 3:
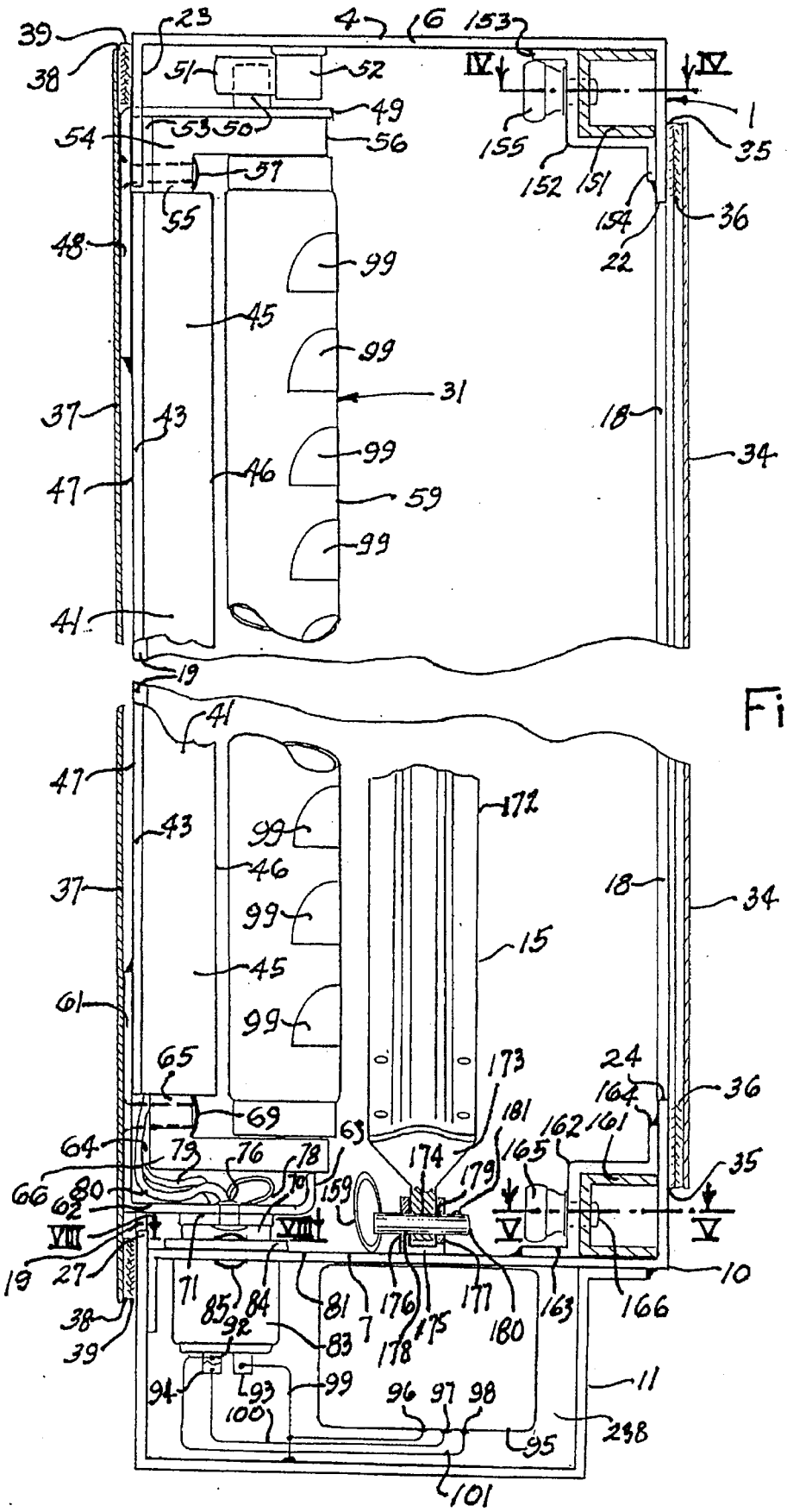
FIG. 3 is a fragmentary vertical sectional view, on an enlarged scale, of the form of the invention illustrated in FIG. 1, taken along the vertical centerline which is best indicated by line III—III of FIG. 1.

Referring now to FIGS. 1 and 3 of the drawings, there is illustrated therein a fluorescent backlit display constructed in accordance with the present invention. This display comprises a rectangular frame 1 having spaced left and right vertical channel-shaped frame members 2 and 3, respectively. An upper horizontal frame member 4 is formed of left and right channel-shaped frame sections 5 and 6, respectively, and a lower horizontal frame member 7 is formed of a left-hand section 8 and a right-hand section 10.

Integral with the frame sections 8 and 10, and depending therefrom, are rectangular compartments 9 and 11, respectively, each accommodating a, preferably electronic, ballast for supplying electrical energy to the modular lamp units supported by the respective frame sections 8 and 10. The outer ends of compartments 9 and 11 are each closed by an end wall, the end wall 237 of compartment 9 being shown in FIG. 1, and the end wall 238 of compartment 11 being shown in FIG. 3.

The left-hand vertical frame member 2 terminates at its lower end in a removable footing member 13, and the right-hand frame member 3 similarly terminates at its lower end in a removable footing 12. A pair of rigidifying struts 14 and 15, to be described in detail hereinafter, respectively connect the left-hand vertical frame member 2 with the lower frame section 8, and connect the right-hand vertical frame member 3 with the right-hand lower frame section 10.

Figure 2:
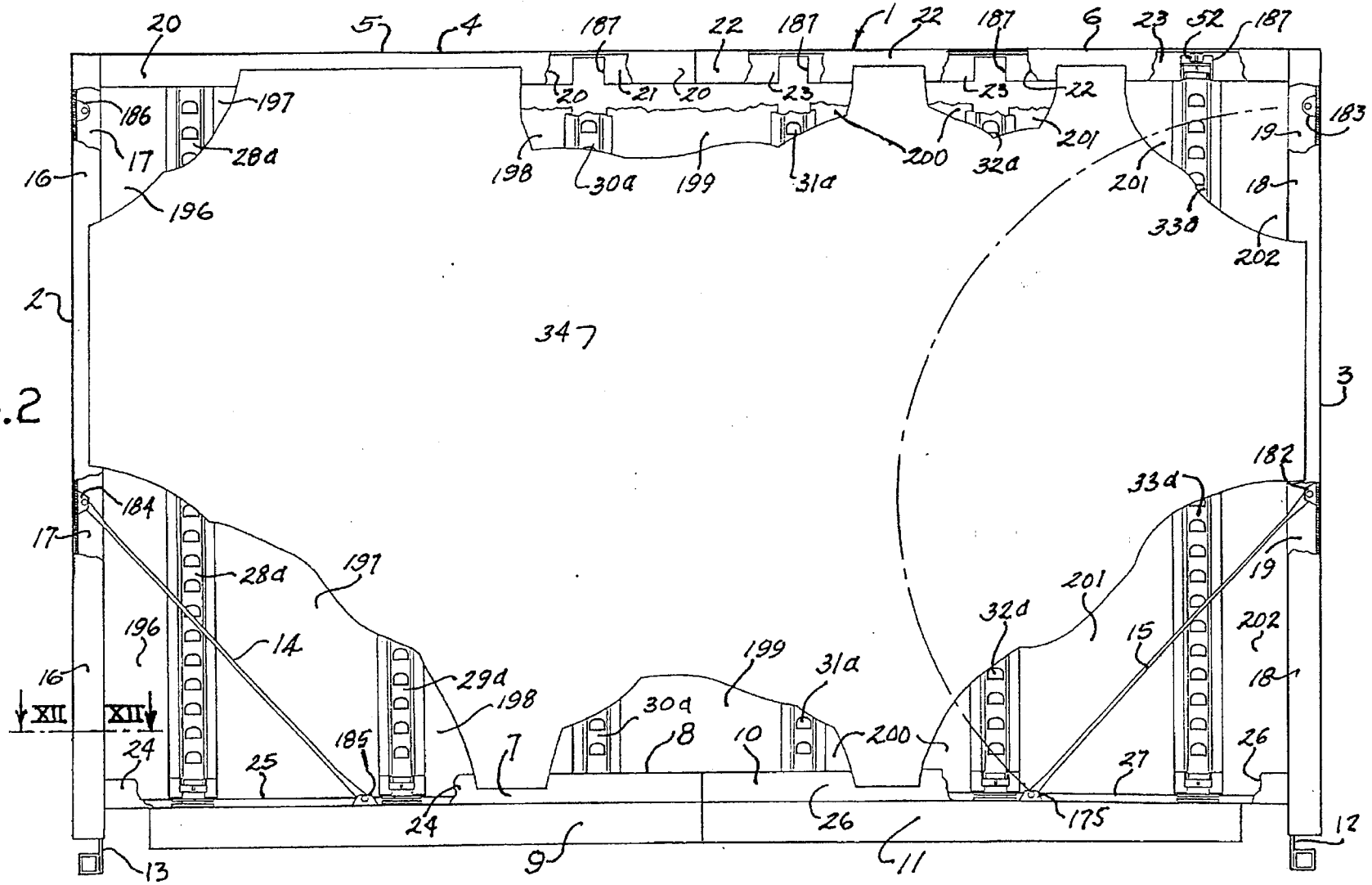
FIG. 2 is a front elevation of an alternative and the presently preferred form of the invention in which the construction of the modular lamp units and of the rear wall are modified, parts of the display panel and other elements being broken away to better illustrate structural features.

The left-hand vertical frame member 2 is provided with a front flange 16 and a similarly sized rear flange 17 shown in FIG. 2; and the right-hand vertical frame member 3 is provided with a front flange 18 and a similarly sized rear flange 19 also shown in FIG. 2. The upper left-hand horizontal frame section 5 is formed with a front flange 20 and a similarly sized rear flange 21. The upper right-hand horizontal frame section 6 is correspondingly formed with a front flange 22 and a similarly sized rear flange 23.

Figure 12:
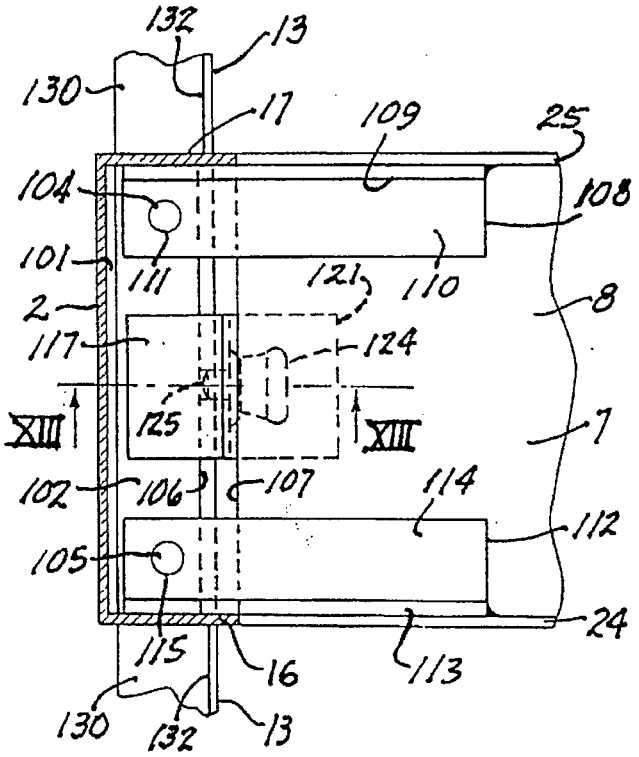
FIG. 12 is a horizontal sectional view of the lower left hand corner of frame 1 taken along the line XII—XII of FIG. 2.

The left-hand lower horizontal frame section 8 is formed with a front flange 24 and a rear flange 25 best shown in FIG. 12, and the right-hand lower horizontal frame section 10 is correspondingly formed with a front flange 26 and a rear flange 27 shown in FIG. 2. The rear flanges 25 and 27 of Sections 8 and 10, respectively, have a substantially lower profile than the front flanges 24 and 26 of said frame sections. The upper and lower horizontal frame members 4 and 7 of frame 1 respectively provide support for the upper and lower ends of plug-in type similar modular lamp units 28, 29, 30, 31, 32 and 33 which are in equally spaced parallel relation, for example on ten inch centers.

The front flanges 16, 18, 20, 22, 24 and 26 of the rectangular frame 1, best shown in FIGS. 1 and 2, have substantially coplanar front surfaces which define a rectangular opening. A rectangular light transmissive, rollable display panel 34 is disposed in registration with the front surfaces of the frame 1 and has marginal portions thereof removably attached to said front surfaces in laminate relation, for example by means of hook and loop type connectors 35 and 36, in a manner well known in the art.

The rear flanges 17, 19, 21, 23, 25 and 27 of the frame 1, best shown in FIG. 2, have rear surfaces which are also substantially coplanar and define a rectangular rear opening. In the form of the invention illustrated in FIG. 3, a rectangular rear wall member 37, for example, of rollable white substantially nonspecular diffusely reflective plastic or fabric sheet material, is disposed in registration with the rear flanges of frame member 1 and is removably attached thereto in laminate relation by hook and loop type connectors 38 and 39 in a manner similar to the attachment of the display panel 34 to frame 1.

Figure 6:
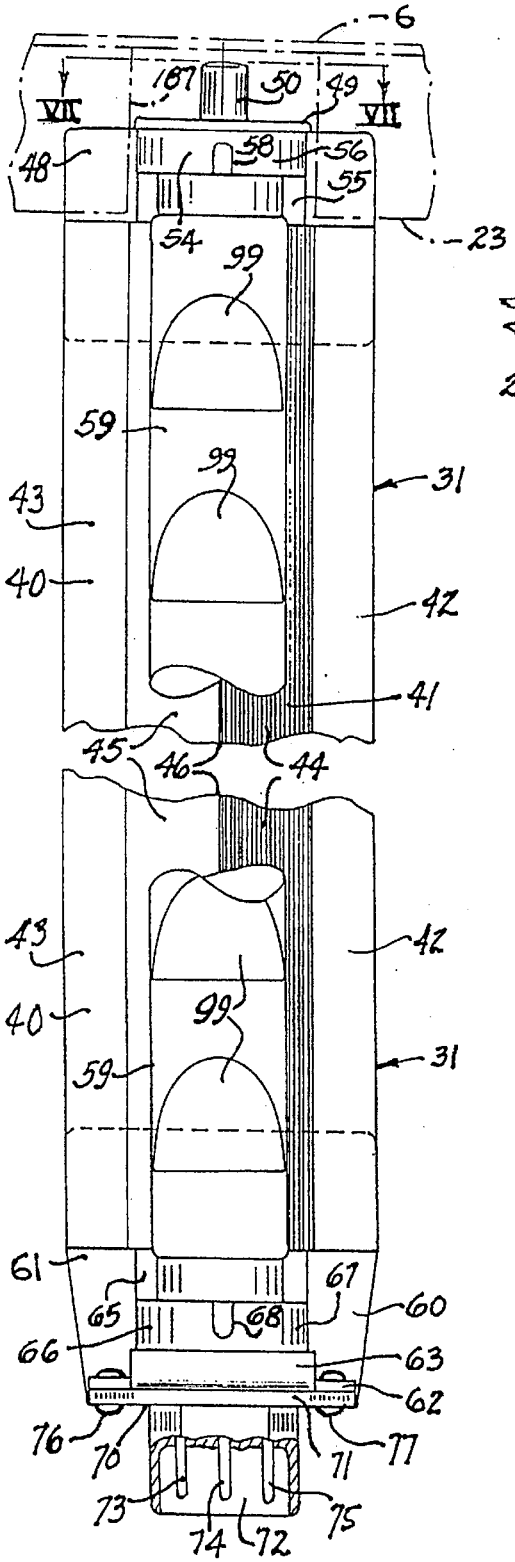
FIG. 6 is a front elevational view of the type of modular lamp unit incorporated in the form of the invention shown in FIG. 1.
Figure 7:
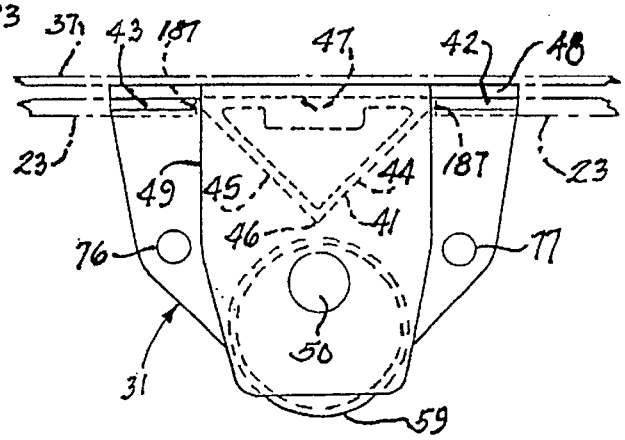
FIG. 7 is a plan view of the upper end of the modular lamp unit of FIG. 6 taken along the line VII—VII of FIG. 6.

Since all of the modular lamp units 28 to 33 are similar, the structure thereof will be described with respect to the unit 31 shown in FIGS. 3, 6 and 7. The modular unit 31 comprises a base member 40 having an elongated main body portion 41 which may take the form of a unitary tubular aluminum extrusion, the cross section of which is best shown in FIGS. 6 and 7 as being triangular and formed with coplanar oppositely outwardly directed flanges 42 and 43. The member 41 is provided with elongated rectangular reflective external surfaces 44 and 45 which extend generally normal to each other and which are joined at a vertex 46. The body member 41 also has a planar rear surface 47 which is disposed between and is coplanar with the rear surfaces of the flanges 42 and 43 and provides therewith a planar overall rear surface for the base member 40.

Fixed, as by welding, to the upper ends of the rear surfaces of the flanges 42 and 43 as well as to the upper end of surface 47 of the body member, is an L-shaped, preferably steel, bracket 48. A vertical or longitudinal portion of the bracket 48, which overlies the rear surface 47 and flanges 42 and 43, has a width coextensive therewith as best shown in FIG. 6, and the upper end of said vertical portion extends beyond the end of the body member 41, maintaining the aforementioned width. The bracket 48 has a right angled horizontal extent 41, best shown in FIGS. 3, 6 and 7, which carries on its upper surface a longitudinally extending cylindrical latch pin or member 50 which may be formed of aluminum or plastic. In the operative position of the lamp module 31 shown in FIG. 3, the pin 50 is latched or locked between a pair of resilient spaced opposing arms 51 of a latch 52 which is mounted on the underside of the web of the upper horizontal frame section 6 as shown.

A rectangular spacer or shim 53 overlies the inner surface of the portion of the vertical extent of bracket 48 extending beyond the upper end of the tubular body member 41, and a standard fluorescent lamp receptacle 54 of L-shaped configuration in side view has a vertically or longitudinally extending base 55 which overlies the spacer 53. Receptacle 54 also has a horizontal arm 56 which underlays the lower surface of horizontal arm 49 of bracket 48 as shown. The receptacle base portion 55, the shim 53, and the bracket 48 are suitably apertured to receive means 57 for fastening said receptacle to base member 40. Fastening means 57 may take the form of a rivet, as shown, a machine screw with cooperable nut, or the like. As best shown in FIG. 6, the outer end of the arm 56 of receptacle of 54 is slotted, as at 58, to receive the spaced parallel pins or electrodes (not shown) which project from the end of an associated fluorescent lamp 59 mounted therein. Lamp 59 is preferably of the well known T-8 triphosphor type which exhibits optimum color balance.

As best shown in FIGS. 3 and 6, the modular lamp unit 31 also has a, preferably steel, bracket 60 having a longitudinally extending flat portion 61 which is fixed, as by welding, to the rear surface 47 and flanges 42 and 43 of the body member 41 adjacent the end thereof opposite that to which the bracket 48 is fixed. The bracket portion 61 extends longitudinally beyond the lower end of the body member 41 to a transversely extending flat portion 62 terminating in an inturned end portion 63.

Figure 8:
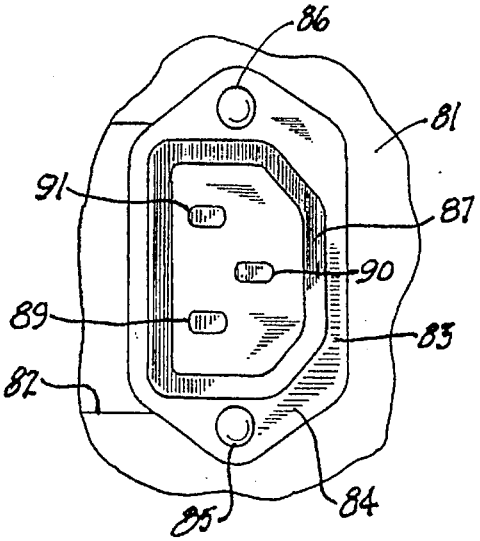
FIG. 8 is a plan view of the upper end of a female socket or electrical connector taken along the line VIII—VIII of FIG. 3.

A rectangular spacer or shim 64, which is similar to the spacer 53, overlies the inner surface of the longitudinal bracket portion 61 adjacent the lower end of the tubular body member 41, and disposed in overlying relation with spacer 64 is the base portion 65 of an L-shaped fluorescent lamp receptacle 66. Receptacle 66 is similar to the receptacle 54 and has a laterally extending arm portion 67 formed with a slot 68 (FIG. 6) corresponding to slot 58. The bracket portion 61, spacer 64 and the base portion 65 of receptacle 66 are suitably apertured to receive means 69 for fastening receptacle 66 to base member 40. Fastening means 69 may take the form of a rivet, a machine screw and cooperable nut, etc. As shown in FIGS. 3, 6 and 8 the terminal inturned end portion 63 of bracket 60 abuts the lower surface of the receptacle portion 67 adjacent the outer end thereof.

Mounted on the outer surface of the portion 62 of the bracket 60 is a male electrical connector 70 which, in the illustrated embodiment of the invention, is of specialized construction and is commercially avaliable as Switchcraft™ part No. EAC324. The body of connector 70 is formed of insulating plastic material, and has a transverse external flange 71 as well as a longitudinally extending tubular extension or skirt portion 72 which surrounds plug-in type prongs or electrodes 73, 74 and 75. As shown in FIG. 6, all of the prongs 73 to 75 are parallel. However, the center prong 74 is offset laterally from the outer prongs 73 and 75.

The flange 71 of connector 70 and the portion 62 of bracket 60 are apertured to receive securing means, such as rivets 76 and 77, by which said flange, and thereby connector 70, is fixed to the bracket 60. The bracket portion 62 is formed with a suitable aperture (not shown) for receiving the upper end of the body of the connector 70.

With further reference to FIG. 3, a wire 78 is connected at one end to the ground prong 74 of the connector 70, and at the other end is grounded to the base member 40, for example by connection to the rivet 76. An insulated wire 79 is connected at one end to the prong 75 of connector 70, and at its other end is connected to one of the two terminals (not shown) in the lower lamp receptacle 66. The other terminal in the receptacle 66 is suitably grounded to the base member 40 by connection means not shown. An insulated wire 80 is connected at one end to the prong 73 and extends through tubular body member 41 to the upper lamp receptacle 54 where it is connected to one of the two terminals (not shown) therein. The other of said terminals is suitably grounded to the base member 40 by connection means not shown.

Referring now to FIGS. 3 and 8, the horizontal web 81 of section 10 of the lower horizontal frame member 7 is formed with a suitable opening, which may take the form of a notch 82 (FIG. 8) in which a female electrical connector 83 is received. The connector 83 may be Switchcraft™ part No. EAC 306 which is also commercially available. The insulated plastic body of connector 83 is formed with a peripheral flange 84 at its upper end which is apertured to receive securing means such as rivets 85 and 86 which fix the connector 83 to the web 81.

The female connector 83 is complementary to the male connector 70, being formed, as shown in FIG. 8, with an annular recess 87 shaped to telescopically receive the tubular extension or skirt 72 of the male connector 70. The body of connector 83 has a planar upper surface portion 88 surrounded by the annular recess 87, which surface is generally coplanar with the upper surface of the flange 84. As shown in FIG. 8, the surface 88 is formed with slots 89, 90 and 91 which are adapted to respectively receive the prongs 73, 74 and 75 of the male connector 70 when the skirt 72 of the male connector 70 is telescopically inserted into the recess 87 of the female connector 83. The female connector 83 is provided with external terminals 92, 93 and 94 (FIG. 3) which are respectively connected to the electrodes (not shown) in slots 89, 90 and 91.

Each of the wiring compartments 8 and 11 has mounted therein a power supply for the modular lamp units in its respective section. In each case the power supply takes the form of a preferably electronic ballast, and in FIG. 3 a ballast 95 is shown mounted in the compartment 11. Since the ballasts are located at the base of frame 1, their weight lends a low center of gravity to displays of the present invention. The ballast 95 is connected to and has an output capable of supplying all of the modular lamp units supported by the right-hand half of the frame 1, i.e., units 31, 32 and 33 in FIG. 1, and the electrical connection to each such units is identical with that shown diagrammatically in FIG. 3.

More specifically, the conductor 99 connects the ground terminal 93 of the female connector 83 to the ground terminal 96 of the ballast 95 and is additionally connected to the metallic compartment wall 11 as shown. An electrical connector 100 connects the terminal 94 of the female connector 83 with the output 97 of the ballast 95, and an electrical connector 101 connects the terminal 92 of the female connector 83 to the output terminal 98 of ballast 95. A separable plug-in cord (not shown) connects the circuitry of ballast 95, with that of the corresponding ballast (not shown) in the compartment 9, and an external power cord (not shown) is provided for connection of both ballasts to a suitable external power source.

As shown in the drawings, all of the fluorescent lamps used in the display of the present invention are provided with masking means on the surface thereof facing the display panel 34. The masking means 99 on lamp 59 in FIG. 3 is illustrative. This masking means is disclosed and claimed in my U.S. Pat. No. 5,282,117 and provides, in a backlit display having a depth from display panel to rear wall of about five inches, a brightness at the display panel of the order of 300 ft. lamberts, with a brightness variation between lamps which is of the order of less than 3%.

Figure 13:
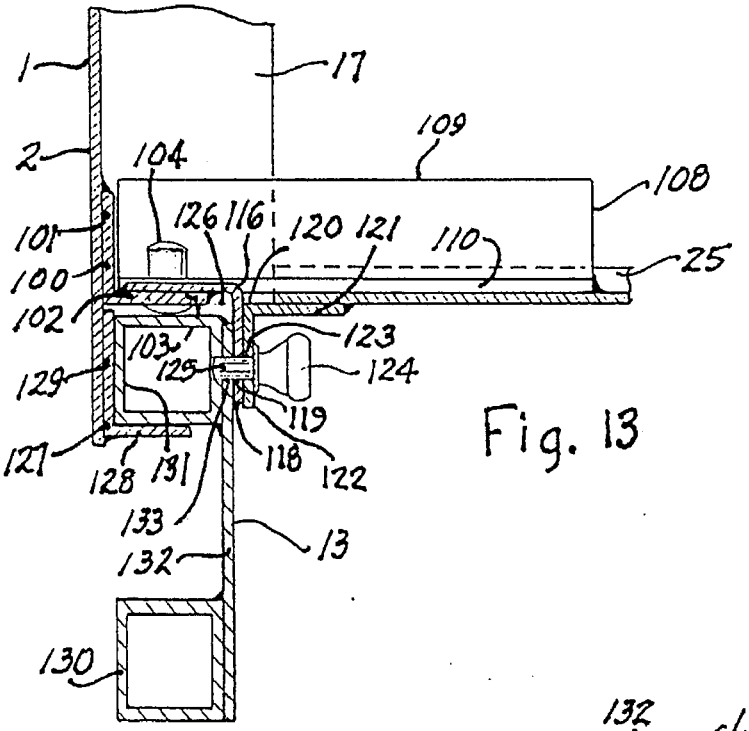
FIG. 13 is a vertical sectional view taken along the line XIII—XIII of FIG. 12.

Fluorescent backlit displays constructed in accordance with the present invention have two very important attributes. The first is that the display can be quickly and easily assembled and disassembled, essentially without the need for any tools. The second is that, when assembled, the rectangular frame 1 is rigidly held in the desired rectangular configuration. The present invention employs rigid frame corner joints which can be readily disassembled by simple manual retraction of a joint locking pull pin at each corner. FIGS. 12 and 13 illustrate the structure of the lower left-hand corner of the frame 1 shown in FIGS. 1 and 2. It is understood that the lower right-hand corner of the frame 1 has a similar joint structure.

As shown in FIGS. 12 and 13, a right angle member 100 extends horizontally between the front and rear flanges 16 and 17 of frame member 2 and is fixed, as by welding, to said frame member. The angle member 100 has a vertical flange 101 which overlies the inner surface of the web of the channel-shaped frame member 2 and has a horizontal flange 102. Spaced inwardly from the opposite ends of the angle member 100, the horizontal flange 102 is formed with a pair of circular vertical bores therethrough, one of which, 103, is shown in dotted lines in FIG. 13. Rigidly fixed within each of the aforementioned bores is a cylindrical upstanding locating pin, both of these pins, 104 and 105, are shown in FIG. 12, and pin 104 is also shown in FIG. 13. It will be observed that the left-hand end of the channel-shaped frame section 8 of lower horizontal frame member 7 terminates in a plane defined by the edges of the flanges 16 and 17 of the channel-shaped vertical frame member 2, which plane is best shown in FIG. 12. Thus, there is a space between the inner edge 106 of the horizontal flange 102 of angle 100 and the opposing edge 107 of the web of the channel-shaped horizontal lower frame section 8.

A right angle member 108, having a vertical flange 109 in overlying relation with the inner surface of the rear vertical flange 25 of frame section 8 and a horizontal flange 110 in overlying relation with the web of said frame section, is fixed, as by welding, to the aforementioned flange 25 and web of the channel frame section 8. The angle member 108 extends leftward as viewed in FIG. 12 beyond the left-hand end of frame section 8 and into overlying relation with the upper surface of the horizontal flange 102 of the angle member 100. The projecting end of angle 108 is formed in its horizontal flange 110 with a cylindrical bore in which the locating pin 104 has a snug sliding fit.

A right angle member 112 corresponding to angle 108 is fixed, as by welding, to the frame section 8 with the horizontal flange 114 thereof in overlying relation with the web of said frame section and the vertical flange 113 thereof in overlying relation with the inner surface of front flange 24 of said frame section. The angle member 112 extends into overlying relation with the horizontal flange 102 of the angle member 100 and is formed with a cylindrical bore 115 through which the locating pin 105 projects with a snug sliding fit.

Generally equally spaced between the angle members 108 and 112 is a short right angle member 116 having a horizontal flange 117 in overlying relation with the upper surface of the horizontal flange 102 of angle member 100. Angle member 116 also has a depending vertical flange 118, best shown in FIG. 13, which extends vertically downwardly and is formed with a horizontal cylindrical bore 119. The angle member 116 is fixed, as by welding, of its flange 117 to the flange 102 of the angle member 100 as shown.

Fixed, as by welding, to the underside of the web of frame section 8 at the left-hand end thereof, and in alignment with angle member 116, is a short right angle member 120 similar to angle member 116, having a horizontal flange 121 and a vertical flange 122, the latter being formed with a horizontal cylindrical bore 123 of the same size as and coaxial with the bore 119. The vertical flange 122 carries a pull pin assembly 124 of a type well known in the art, which assembly comprises a cylindrical pull pin 125 having a snug sliding fit within the bores 119 and 123. The pin 125 is biased to the position shown in FIG. 13 and can be removed from the bore 119 by manually retracting the head thereof a distance sufficient to cause the inner end of said pin to move at least to the plane of the left-hand vertical surface of flange 122.

With the parts in the positions shown in FIGS. 12 and 13, the vertical frame member 2 and the horizontal frame section 8 are rigidly locked in right angular relationship. However, upon manual retraction of the pull pin 125 from the bore 119, the left-hand end of frame section 8 can be readily moved axially of locating pins 104 and 105 to slidably remove the angle members 108 and 112 beyond the ends of said locating pins and thereby quickly and easily affect disassembly of the illustrated joint structure.

The pull pin 125 not only serves to lock the joint structure aforedescribed in the assembled relation shown in the drawing, but it also serves to lock the footing 13 in the position shown in FIGS. 1, 12 and 13. With reference to FIG. 13, the structure for doing this will now be described.

The rear flange 17 of vertical frame member 2 is cut away at its lower end to terminate along the horizontal line 126 shown in FIG. 13. A right angle member 127 having a length equal to the distance between the front and rear flanges 16 and 17 of frame member 2 has a horizontal flange 128 and a vertical flange 129. The vertical flange 129 overlays the inner surface of the web of the frame member 2 and is welded thereto. The horizontal flange 128 has a width somewhat less than the width of the horizontal flange 102 of angle member 100, as shown in FIG. 13.

The footing member 13 is formed of an elongated tubular lower box shaped member 130, and a relatively shorter upper tubular box-shaped member 131 which is in spaced parallel relation with the lower member 130. The members 130 and 131 are integrally joined to a vertical, generally triangular plate 132, as by welding shown. The plate 132 and the wall of upper member 131 in contact therewith are formed with a common cylindrical bore 133 which is in effect an extension of the coaxial cylindrical bores 119 and 123 described earlier herein.

The upper member 131 and the upper portion of plate 132 have a snug slidable fit with in the space between angle member 127 and the vertical flange 118 of angle member 116. However, the cylindrical pull pin 125, by virtue of its locked position within the bore 133, locks the footing 13 against any rearward sliding movement. The footing 13 can be easily removed from the frame 1, for example when frame 1 is supported horizontally face down on a table, by manually withdrawing the knob portion of assembly 124, and thereby the pull pin 125, an axial distance sufficient to remove said pin from the bore 133 and, while said pin is thus retracted, lifting said footing to slide it vertically. Once the bore 133 has been moved out of coaxial relationship with pin 125, said pin can be released as the footing is lifted rearwardly free of the frame 1.

To reinstall the footing 13, all that is necessary is to reinsert the upper tubular box member 131 and the upper portion of the wall 132 of said footing into the cavity supplied by the lower frame structure described, and withdrawing the pin 125 to permit the forward movement of the upper portion of footing 13 past said pin. When the bore 133 is moved into coaxial alignment with the bore 119, the pin 125 snaps into bore 133 to lock the footing in its operative position shown.

The structure at the lower right-hand cover of frame 1 is substantially the same as that described for the lower left-hand corner thereof. Thus, removal and replacement of the footing 12 and disassembly of the lower right-hand corner joint of frame 1 can be readily accomplished in the manner described herein.

Figure 14:
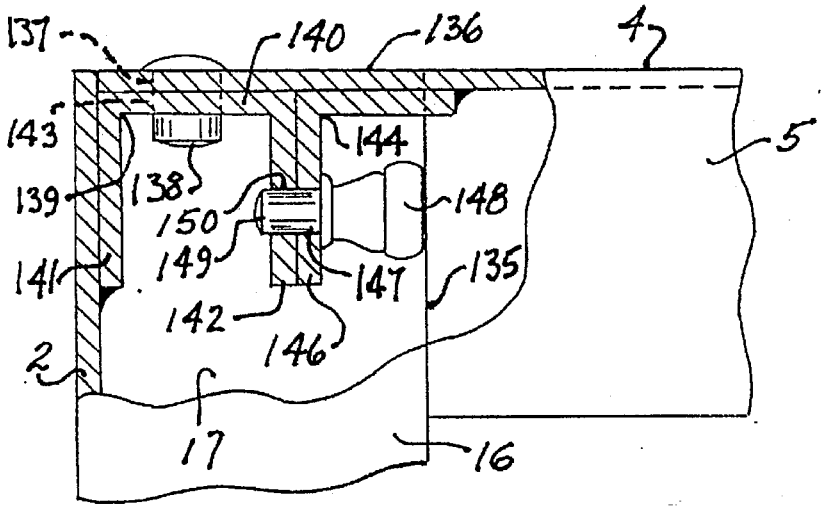
FIG. 14 is a partial vertical sectional view through the upper left hand-corner of frame 1 taken through the same vertical plane as FIG. 13.

The upper corner joints of the frame 1 are similar in action to the lower joints of said frame, but are simpler in structure because of the fact that the footings 12 and 13 are not involved. FIG. 14 illustrates the structure of the upper left-hand corner of the frame 1 with parts being broken away and shown in section along the same vertical plane as that identified in FIG. 12 by the numerals XIII—XIII. As shown in FIG. 14, the rear flange 17 of the left vertical frame member 2 and the rear flange 21 of the left-hand upper horizontal frame section 5 are joined along a vertical plane 135. The front flange 16 of frame member 2 and front flange 20 of the horizontal frame section 5 are also joined along the same vertical plane.

However, a rectangular extent of the web portion of the channel-shaped frame section 5 extends leftward beyond the plane 135 snugly between the front and rear flanges 16 and 17 of frame member 2 and into contact with the inner suface of the upper end of the web of the channel-shaped vertical frame member 2 as shown in FIG. 14. The extended web portion of the frame section 5 provides a rectangular tongue member 136 having a pair of spaced bores therethrough positioned similarly to the spaced bores in the horizontal flange 102 in FIG. 13 having the locating pins 104 and 105 fixedly positioned therein. In FIG. 14, only the bore 137 and the downwardly projecting cylindrical locating pin 138 fixed therein are shown. However, it is understood that there is a similar bore in the tongue 136 which carries a similar locating pin, said bore and pin being spaced from the front flange 16 of the frame member 2 the same distance as the bore 137 and locating pin 138 are spaced from the rear flange 17 of frame member 2.

A downwardly facing member 139 of channel-shaped cross-section extends from in contact with the front flange 16 to contact with the rear flange 17 of the frame member 2 and is fixed, as by welding, to the web portion, as well as to the front and rear flanges 16 and 17 of the frame member 2. The member 139 has a web portion 140 and left and right hand vertical depending flanges 141 and 142, respectively. The web 140 is formed with a bore 143 which is coaxial with and somewhat larger in diameter than bore 137, so that the locating pin 138 has a snug sliding fit therein. A second bore (not shown) is formed in the web 140 adjacent the front flange 16 of frame member 2 for accommodation of the other locating pin (not shown) carried by tongue 136 and referred to earlier herein.

An angle member 144, like member 139, extends from the front flange 16 to the rear flange 17 of the frame member 2. Member 144 has a horizontal flange 145 in contact with the underside of the tongue 136, as well as a vertical flange 146 in contact with the adjacent surface of the flange 142 as shown. The angle member 144 is fixed, as by welding, to the tongue 136 and to the web of the channel-shaped frame section 5.

The vertical flange 146 of the member 144 is formed with a horizontal cylindrical bore 147 and carries a pull pin assembly 148, similar to the assembly 125 shown in FIG. 13, which assembly includes a cylindrical pull pin 149. The vertical flange 142 of member 139 is formed with a cylindrical bore 150 coaxial with and of the same size as the bore 147. The pull pin 149 has a snug sliding fit within the bores 147 and 150, and when pin 149 is in the operative position shown in FIG. 14, the horizontal frame member 5 is rigidly locked in right angular relationship with the upper end of the vertical frame member 2. However, the horizontal frame member 5 can be readily released from the frame member 2 by simply manually retracting the pin 149 from the bore 150. This permits the frame section 5 to be moved longitudinally with respect to frame member 2 to thereby slidably remove the locating pin 138 from the bore 143 and the corresponding locating pin (not shown) from its accommodating bore (also not shown).

Once these locating pins are removed from their accommodating bores in the member 139, the joint structure shown in FIG. 14 is effectively disassembled. It is understood that the structure of the joint in the upper right-hand corner of the frame 1, by which the frame member 6 is joined to the upper end of the vertical frame member 3, is of the same type as that disclosed in FIG. 14 and will therefore not be discussed further herein.

Figure 4:
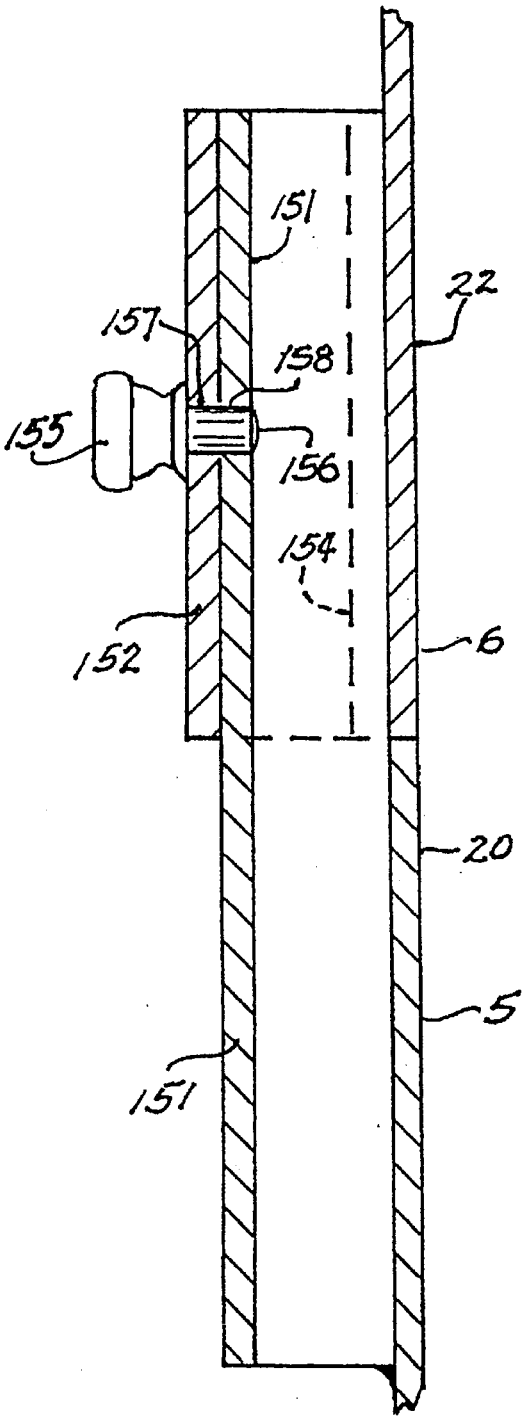
FIG. 4 is an enlarged vertical sectional view of the structure for locking the upper frame sections in abutting aligned relation, said view being taken along the line IV—IV of FIG. 3.

Since the upper horizontal frame member 4 is formed of left and right-hand sections 5 and 6, respectively, and lower horizontal frame member 7 is formed of left and right-hand sections 8 and 10, respectively, means is provided for locking said frame sections in aligned end-to-end abutting relation. The structure therefor is shown in FIGS. 3 and 4 and will now be described.

A channel-shaped member 151, preferably of stainless steel, has about one-half of the length thereof disposed behind the front flange 20 of and underlies the lower surface of the web of the right-hand end of upper frame section 5 and is fixed, as by welding, to said frame section. The other half of the member 151 thus projects beyond the end of frame section 5. As best shown in FIG. 3, a right angled member 152 has flanges 153 and 154 fixed, respectively, as by welding, to the undersurface of the web of the channel-shaped frame section 6 and to the rear surface of the front flange 22 of said frame section. Member 152, the web of frame section 6 and the front flange 22 of said frame section form a tubular enclosure of rectangular cross-section within which the projecting portion of member 151 has a snug telescopic sliding fit which maintains the frame sections 5 and 6 in longitudinal alignment.

The angle member 151 carries a pull pin assembly 155 and has a bore 157 (FIG. 4) in which a cylindrical pull pin 156 is axially slidable. The member 151 is formed with a bore 158 within which the pull pin 156 has a snug slidable fit, and in which said pin is disposed in the operative position of the parts shown in FIG. 4. Disposition of the pull pin 156 within the bore 158 rigidly locks the frame sections 5 and 6 in the abutting end-to-end alignment shown in FIG. 4. However, manual retraction of the pull pin 156 from the bore 158 releases the projecting portion of member 151 for telescopically slidable movement out of the confines of the aforementioned tubular enclosure and thereby permits complete separation of the frame sections 5 and 6.

Figure 5:
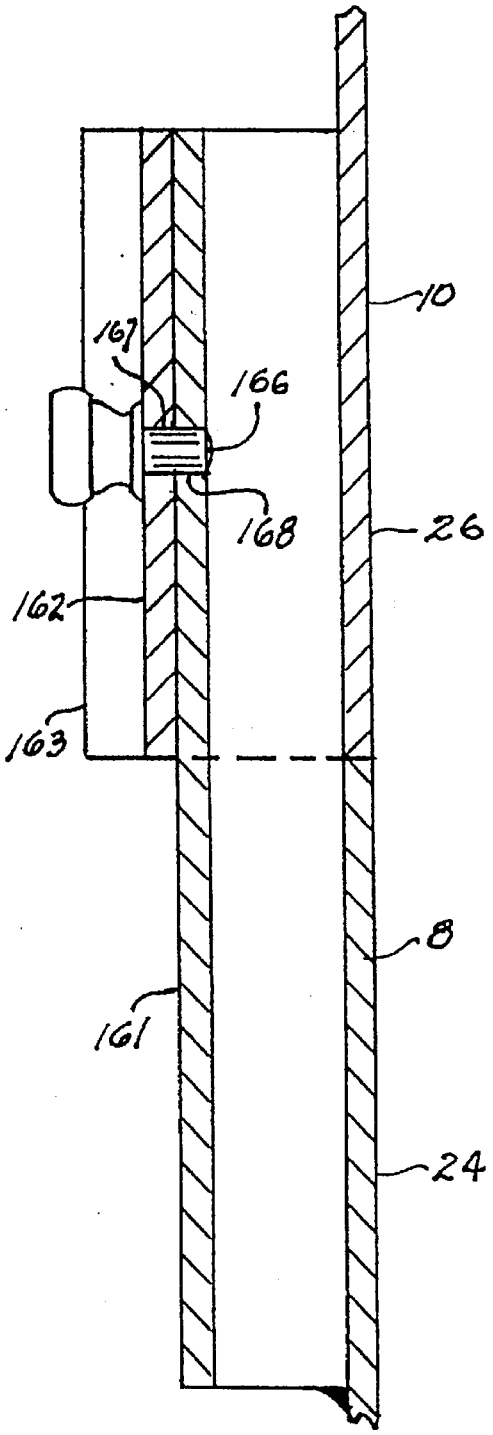
FIG. 5 is an enlarged vertical sectional view of the structure for locking the lower frame sections and the wiring compartments integral therewith in abutting aligned relation, said view being taken along the line V—V of FIG. 3.

Referring to FIGS. 3 and 5, there is illustrated therein a structure for locking the lower frame sections 8 and 10, as well as the compartments 9 and 11 integral therewith, in end-to-end abutting alignment. A channel-shaped member 161, preferably of stainless steel, has about one-half of the length thereof of disposed behind the front flange 24 of and overlies the upper surface of the web 81 of the right-hand end of frame section 8 and is fixed, as by welding, to said frame section. The other half of member 161 thus projects beyond the end of frame section 8. As shown in FIG. 3, a right angled member 162 has flanges 163 and 164 fixed, respectively, as by welding, to the upper surface of web 81 and to the rear surface of the front flange 24 at the left-hand end of frame section 10. Member 162, the web 81 and front flange 24 form a tubular enclosure of rectangular cross section within which the projecting portion of the member 161 has a snug telescopic sliding fit which maintains the frame sections in longitudinal alignment.

The angle member 162 carries a pull pin assembly 165 and has a bore 167 (FIG. 5) in which a cylindrical pull pin 166 is axially slidable. The member 161 is also formed with a bore 168 within which the pull pin 166 has a snug slidable fit, and in which said pin is disposed in the operative position of the parts shown in FIG. 5. Disposition of the pull pin 166 within the bore 168 rigidly locks the frame sections 8 and 10 in the end-to-end abutting alignment shown in FIG. 5. However, manual retraction of the pull pin 166 from bore 168 releases the projecting portion of member 161 for telescopically slidable movement out of the confines of the aforementioned tubular enclosure and thereby permits complete separation of the frame sections 8 and 10.

The strut members 14 and 15, shown in FIGS. 2 and 3, complement the rigid corner joint structures of the frame 1, said struts comprising elongated extents of preferably steel bar 172 having a cross-sectional shape best shown in FIG. 3. To each end of the bar member 172 of the strut 15 is fixed, as by welding or riveting, a flat-ended eye fitting 173 having a transverse bore 174 therethrough.

Mounted on the upper surface of the web 81 of the frame section 10, as by welding or otherwise, is a clevis 175 having upstanding flanges 176 and 177 formed with coaxial bores 178 and 179, respectively. A cylindrical pin 180 has a snug sliding fit within the bores 178, 174 and 179 and is provided with a pull ring 159 as shown. The pin 180 is provided at the end opposite the pull ring 159 with a spring loaded transversely depressible bead 181 which retains the pin 180 in the operative position shown until sufficient axial force is exerted on the pin 180, by pulling on the pull ring 159, to depress the bead 182 and allow removal of the pin from the clevis 175. This, of course, permits disengagement of the eye member 173 from the clevis 175.

The strut 15 has an eye fitting of the same type as fitting 173 at the end opposite said fitting, and said eye fitting has a pivot pin connection with a clevis 182 mounted on the inner surface of the web of the vertical side frame member 3. A similar clevis 183 is mounted on a inner surface of the web of the side frame member 3 a distance above the clevis 182 equal to the distance between the axes of the bores of the eye fittings on the strut 15. Thus, upon removal of the pin 180 from the clevis 175, the strut 15 can be swung upwardly, as indicated by the dot and dash line in FIG. 2, to bring the eye fitting 173 between the flanges of the clevis 183, at which time the pin 180 can be introduced through the bores of the clevis 183 and through the bore of the eye fitting to thereby lock the strut 15 in the storages or shipping position thereof within the frame member 3.

The strut 14 may be identical with the strut 15 and is provided with eye fittings at each end thereof. One end of the strut 14 is pivoted within a clevis 184 and is releasably connected to a clevis 185 on the web of the lower horizontal frame section 8. A clevis 186 is mounted on the inner surface of the web of the side frame member 2 and is spaced above the clevis 184 a distance equal to the distance between the bores of the eye fittings on the ends of the strut 14. Upon release of the strut 14 from the clevis 185, the eye fitting on the free end thereof can be pinned to the clevis 186 in the storage or shipping position of said strut 14.

An important aspect of the present invention is the fact that the female receptacle 83 for each of the modular lamp units 28 to 33 is mounted on a lower horizontal frame section 8 or 10 in a predetermined position, and that the latch 52 for each modular lamp unit is mounted on the underside of the web of one of the upper horizontal frame sections 5 or 6 in a predetermined precise position vertically aligned with the respective female socket therebelow 83. Thus, placement of a given modular lamp unit in its operative plugged-in and latched position, not only insures precise location and orientation of the lamp unit, but it also automatically connects said unit to the power source by the act of plugging said unit into the female socket. It is understood, of course, that when a modular lamp unit is being installed or removed from operative position, the rollable rear wall member 37 is removed from the back of the frame 1, for example by grasping one corner of said member and peeling the hook type connector strip 38 on the margins thereof away from the loop type connector strip on the frame 1.

To facilitate movement of the upper end of a given modular lamp unit in a fore and aft direction into and out of operative position, the rear flanges 21 and 23 of the upper frame sections 5 and 6 are formed with rectangular cut away portions or notches 187 as shown in FIG. 2. At the top of FIG. 6, the rear flange of the frame section 6 is shown in phantom lines, and a cut out or notch 187 is also shown in phantom lines to illustrate the fact that the upper left and right hand corners of the longitudinally extending portion of the steel angled bracket 48 overlap portions of the flange 23 on each side of the notch 187. FIG. 6 also illustrates in phantom lines that the notch 187 is wide enough to permit the narrow horizontal or transversely extending portion 49 of bracket 48, as well as the lamp receptacle 54, to pass freely therethrough.

The upper corners of the portion of the vertical extent of bracket 48 above the upper end of tubular body member 41 contact the flange 23 in the operative position shown in FIG. 3. The contact of the upper corner portions of the bracket 48 with the flange 23 is important because, with latch 52 and pin 50, it defines the operative position of the upper end of the illustrated module 31. The spring action of the latch arms 51 biases the cylindrical latch pin 50 forwardly to thereby hold bracket 48 in positive contact with the rear surface of the flange 23.

FIGS. 2 and 9 to 11 illustrate a modified and presently preferred form of modular lamp unit and rear wall structure of the invention. In FIGS. 2 and 9 to 11 the elements indicated by reference numerals in combination with the subscript "a" correspond to the elements in the other figure indicated by the same reference numerals without a subscript.

Figure 11:
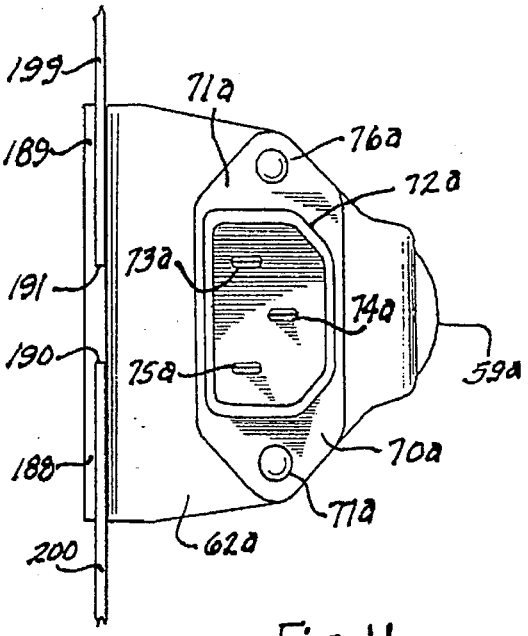
FIG. 11 is a lower end view of the modular lamp unit of FIG. 9 as viewed along the line XI—XI of FIG. 9.
Figure 10:
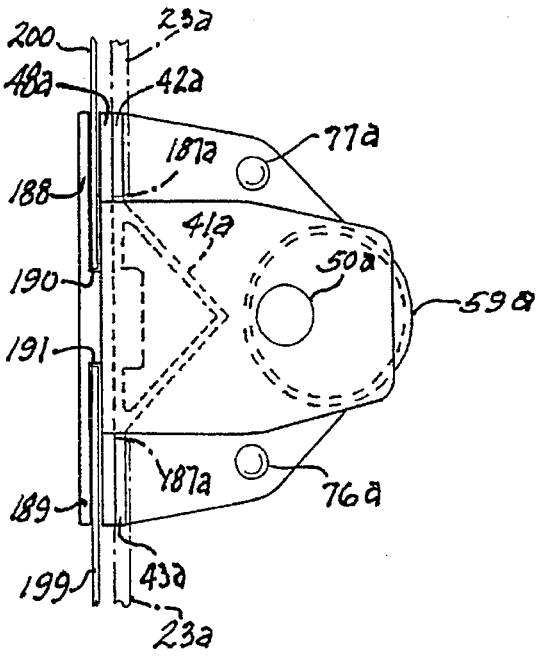
FIG. 10 is a plan view of the upper end of the modular lamp unit of FIG. 9 taken along the line X—X of FIG. 9.

The modular lamp units 28*a* to 33*a* are all alike, and unit 31*a*, which is illustrative thereof, has a tubular body member 41 which differs from the body member 41 in FIGS. 3, 6 and 7 in that it is provided with oppositely outwardly directed flanges 188 and 189 which are spaced from and parallel with the flanges 42*a* and 43*a*, respectively to define therebetween oppositely outwardly facing longitudinally extending slots 190 and 191, respectively. In addition, the one piece rollable rear wall member 37 shown in FIGS. 1 and 3 is replaced by a plurality of equally spaced rollable elongated rectangular panels or sections 196 to 202, best shown in FIG. 2. Opposite longitudinal marginal portions of sections 197 to 201 are accommodated within the slots 190 and 191 of the adjacent lamp units. FIGS. 2, 10 and 11 show marginal portions of rear wall sections 199 and 200 accommodated within the longitudinal slots 191 and 190, respectively.

Figure 9:
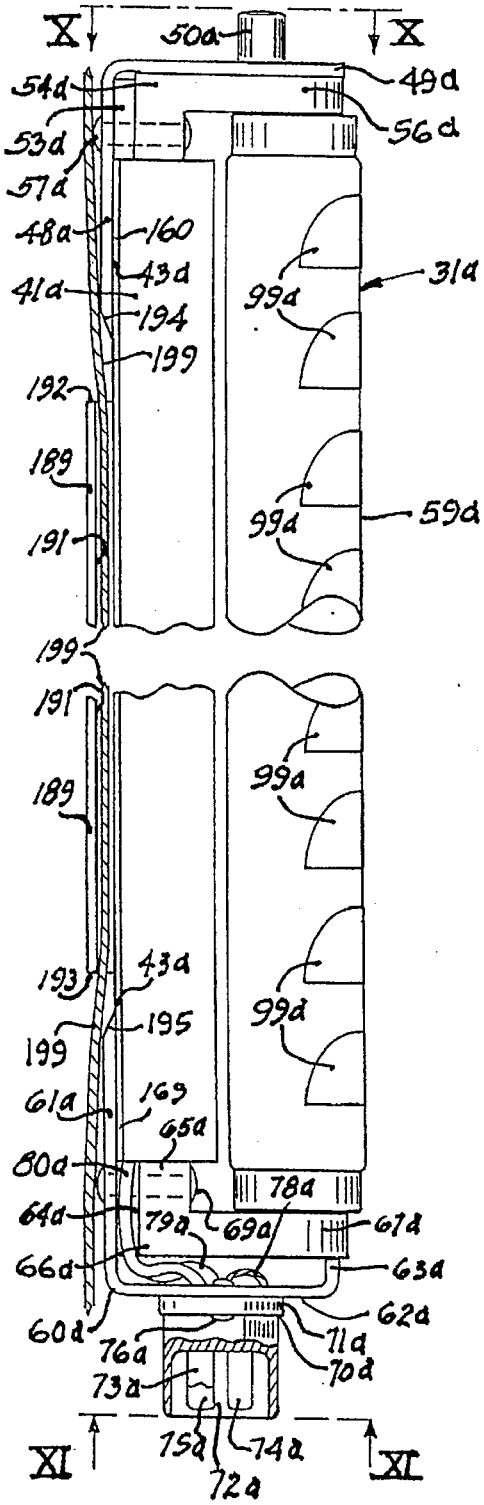
FIG. 9 is a side elevational view of the presently preferred form of modular lamp unit of the invention.

As best shown in FIG. 9, tubular body member 41*a*, which is preferably a unitary aluminum extrusion, has portions of the flanges 188 and 189, as well as the stock between the slots 190 and 191, removed, as by machining, beginning at the point 192 and extending upwardly to the upper end of the member 41*a*. This exposes a planar surface 160 coplanar with the rear surfaces of the flanges 42*a* and 43*a* to which coplanar surfaces the longitudinal or vertical extent of the bracket 48*a* is attached, as by welding, in laminate relation. It will be observed that the lower end of the vertical extent of the bracket 48*a* is bevelled, as at 194, and is spaced from the point 192 which defines the upper end of the flanges 188 and 189.

With further reference to FIG. 9, the lower end of the tubular body member 40*a* is similarly machined to remove the flanges 188 and 189, as well as of the stock between the slots 190 and 191, to expose a planar surface 169 coplanar with the rear surfaces of the flanges 42*a* and 43*a*. This machining begins at the point 193 and extends to the lower end of the body member 41*a*. The vertical extent 61*a* of the lower bracket 60*a* is disposed in laminate relation with the surface 169 as well as the coplanar rear surfaces of flanges 42*a* and 43*a*, and is affixed thereto as by welding. It will be observed that the upper end of the vertical extent 61*a* of bracket 60*a* is bevelled, as at 195, and is spaced from the point 193, which defines the lower end of flanges 188 and 189.

As shown in FIG. 3 and in dot-and-dash lines in FIG. 6, the upper corners of the vertical extent of the bracket 48 overlay the rear flange 23 of the upper frame section 6 laterally outwardly of the notch 87. Thus, when the modular lamp unit 30 of FIG. 3 and 6 is replaced by the modular lamp unit 31*a* of FIGS. 9 to 11, the upper corners of the vertical extent of bracket 48*a* bear the same relation, i.e., they overlap, the portions of rear flange 23 of the upper frame section 6 outwardly of the notch 187 therein.

Referring now to FIGS. 9 and 10, the width of the slots 190 and 191 is substantially greater than the thickness of the rollable rear wall sections 199 and 200, so that said rear wall sections can be placed in the operative position shown in FIGS. 2 and 9 to 11 by introduction of said panels at either the upper or lower ends of the flanges 188 and 189, said sectional panels being freely slidable within the slots 190 and 191. Once in the operative position shown in FIGS. 9 and 10, the panels 199 and 200 can be retained in the operative position by any suitable means. One such means may take the form of a strap (not shown) fixed at one end to the upper end of each such panel and releasably attached at the other end to the adjacent rear flange of upper horizontal frame member 4, for example by hook and loop fastener means (not shown).

As will be apparent hereinafter, during assembly, disassembly and packing of the backlit display of the present invention, the fluorescent lamps need not be, and are not intended to be removed from the modular lamp units. Moreover, the invention contemplates the use of modular lamp units respectively sized to accommodate fluorescent lamps having a length of 3, 4 or 5 feet. Nevertheless, the unitary nature of the flanged triangular tubular body members 41 and 41*a*, provides all lengths of the base members 40 and 40*a* with the rigidity necessary to resist bending into misalignment with the lamps carried thereby when said modular lamp units are subjected to the rough handling which sometimes occurs in assembly, disassembly or packing of the elements of displays. This construction permits users to grasp the modular lamp unit anywhere along the length of base members 40 and 40*a*. Moreover, the generally triangular configuration of the modular lamp units in end view shown in FIGS. 7, 10 and 11 lends itself well to compact packing in a manner which will now be described.

Figure 15:
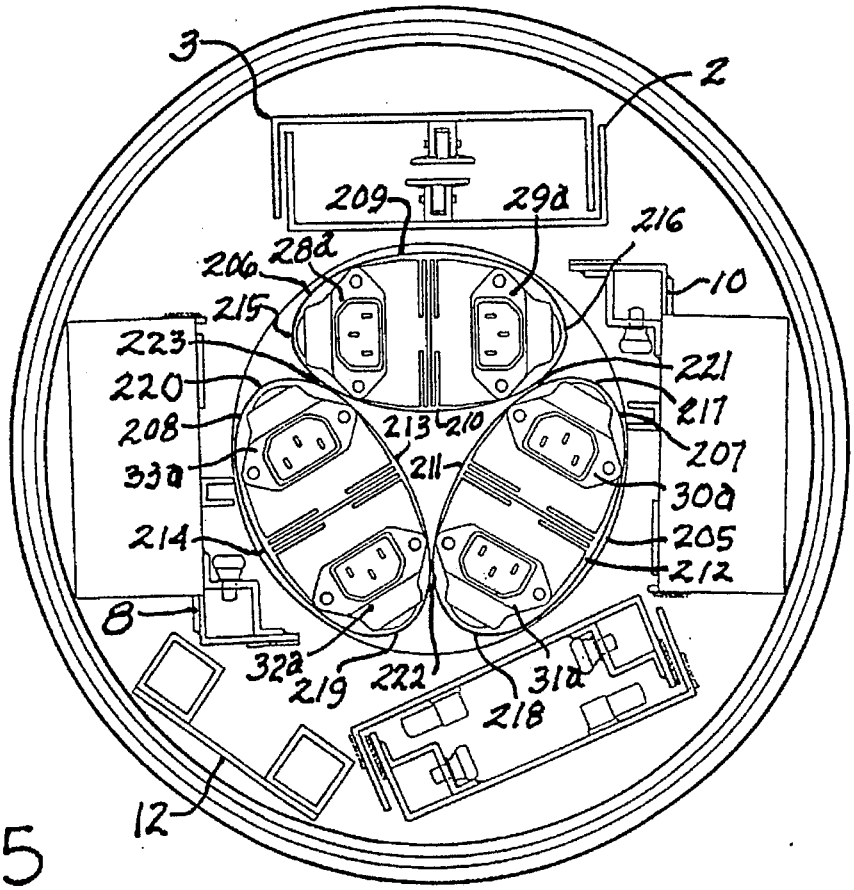
FIG. 15 is a plan view of a cylindrical shipping container with the cover removed, showing packed therein all of the elements of a six lamp unit backlit display of the present invention.

FIG. 15 illustrates one form of packing of the disassembled major components of the display of the invention. A shipping container 203 has a cylindrical sidewall 204 and which may be formed of any suitable rugged material such as plastic, metal or fiber. Disposed coaxially within the container 203 is an elongated cylindrical retainer member 205 formed of resilient plastic sheet material. The retainer 205 defines a surrounding annular space between the external surface of retainer 205 and the inner surface of the cylindrical container wall 204.

FIG. 15 illustrates the packaging of six modular lamp units 28*a* to 33*a* in a remarkably shock free environment within retainer 205. More particularly, pairs of modular lamp units 28*a* to 33*a* are shown disposed with the planar base surfaces of each pair in back-to-back contact or with a suitable cushioning or fastening layer (not shown) interposed therebetween, said pairs of lamp units being enclosed within elongated protective packing sleeves 206, 207 and 208 having an elliptical cross-section and which are formed of resilient plastic sheet material.

The sleeves 206 to 208 may be formed with the elliptical cross-sectional shape shown, or may, for example, be normally cylindrical in their unstressed state. In the latter case, the diameter of each sleeve in its unstressed state, is such that when two modular lamp units in back-to-back relation are introduced axially thereinto as shown, said sleeve is stretched to the elliptical cross-sectional shape shown. It will be observed that, when the lamp units 28*a* to 33*a*, enclosed within the sleeves 206 to 208 are packed within cylindrical retainer 205 as shown in FIG. 15, the outer surface of each of said sleeves preferably contacts the inner surface of the cylindrical retainer 205. In addition, the protective sleeves 206, 207 and 208 each preferably contacts the other two.

With the illustrated packaging arrangement in which lamp units which are generally triangular in end view are packed in pairs within resilient sleeves of elliptical cross section, substantial flexure of the protective sleeves is required before there can be a transfer of any substantial force from a modular lamp unit in one sleeve to another in a next adjacent sleeve. It is understood that the modular lamp units 28 to 33 are also packable within the sleeves 206 to 208 and cylindrical retainer 205 in the same manner as lamp units 28*a* to 33*a*.

Overlaying the inner surface of the cylindrical wall 204 is the rollable display panel 34, within which the rollable one piece rear wall 37 shown in FIG. 3 is overlayed. Alternatively, the rollable rear wall sections 196 to 202 shown in FIG. 2 may be substituted for the rolled rear wall 37 shown. An elongated cylindrical protector 239 of resilient plastic sheet material is disposed coaxially between the cylindrical retainer 205 and container wall 204 and inwardly of the rolled display panel 34 and rear wall means 37 or 196 to 202.

Disposed longitudinally within the annular space between the cylindrical retainer 205 and the cylindrical protector 239 are the lower frame section 8 with its integral compartment 9 and the lower frame section 10 with its integral compartment 11 in diametrically opposite locations. Also disposed longitudinally within the aforementioned annular space are the nested upper horizontal frame sections 5 and 6 and the nested vertical frame members 2 and 3. Similarly, disposed longitudinally within the aforementioned annular space are the footings 12 and 13 which are arranged in end to end relation so that only the footing 12 is visible in FIG. 15.

The bottom of the container 203 may be overlayed with cushioning material (not shown) to protect against endwise shock to the contents of the container 203. The container 203 is also provided with a removable cylindrical cover, not shown, which preferably has an inner surface overlayed with cushioning material (not shown) corresponding to that in the bottom of the container.

It will be apparent from FIG. 15 that each of the packing tubes 206 to 208 has an elliptical cross sectional shape defined by a pair of oppositely disposed gently curving elongated sidewall portions which merge with relatively sharply curved oppositely disposed end wall portions. The elongated sidewall portions of the cross section of the tube 206 are indicated by the numerals 209 and 210, those of tube 207 are indicated by the numerals 211 and 212, and those of tube 208 are indicated by the numerals 213 and 214, respectively. The end wall portions of the cross section of the tube 208 are indicated by the numerals 215 and 216, those of tube 207 are indicated by the numerals 217 and 218, and those of tube 208 are indicated by the numerals 219 and 220, respectively.

Opposite ends of wall portions 209, 212 and 214 of the elliptical packing tubes 206, 207 and 208, respectively are juxtaposed to and preferably contact the inner surface of the cylindrical retainer 205. The adjacent end portions of the elongated wall portions 210 and 211 of the cross sections of tubes 206 and 207 are juxtaposed and preferably contact at point 221. Similarly, adjacent end portions of the elongated wall portions 211 and 213 of the cross sections of tubes 207 and 208 are juxtaposed and preferably contact at point 222; and adjacent end portions of the wall portions 210 and 213 of the cross sections of tubes 206 and 208 are juxtaposed and preferably contact at point 223.

In the packaging provided by the structure illustrated in FIG. 15, radial forces exerted on the cylindrical retainer 205 are absorbed by the base members of the modular lamp units 28*a* to 33*a*, and the fragile lamps of said lamp units are protected by the resilience of the packing tube wall portions. The packing tube wall portions maintain the lamp portions of the packed modular lamp units spaced, not only from the cylindrical retainer, but also spaced from each other.

Figure 16:
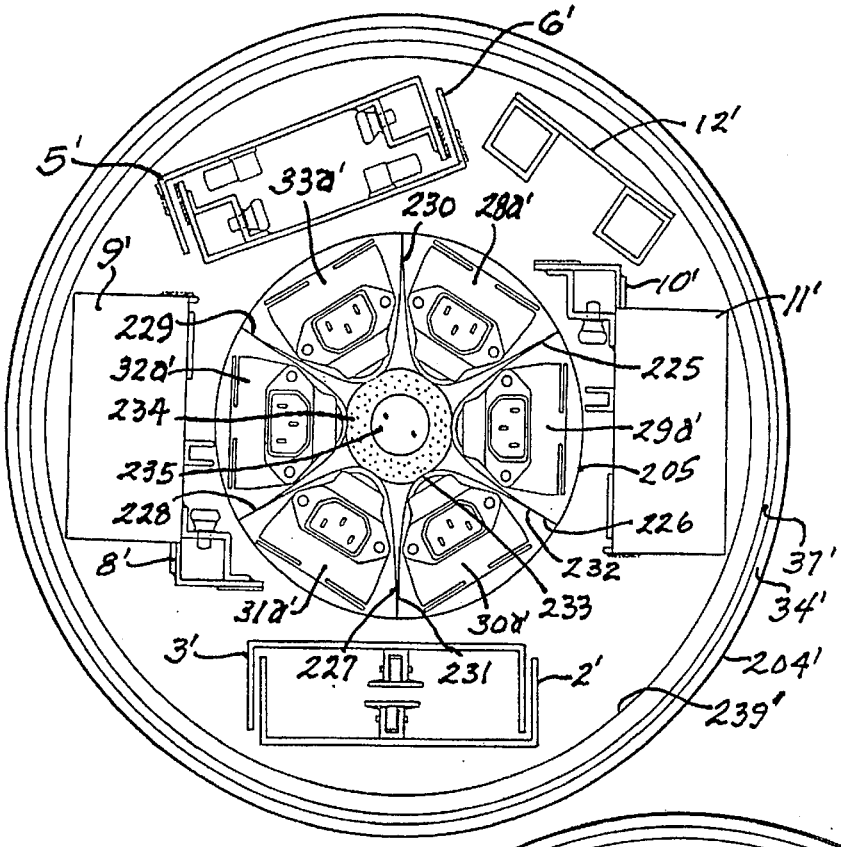
FIG. 16 is a view similar to FIG. 15 showing all of the elements of a six lamp unit backlit display of the present invention, packed in an arrangement somewhat different from that shown in FIG. 15.

FIG. 16 illustrates an alternate packaging of the disassembled major components of the backlit display of the present invention. In FIG. 16 the various components indicated by reference numerals with a prime exponent (') are substantially the same as the components indicated by the same reference numerals without a prime exponent in FIG. 15 and will not be further described. It will be observed that the modular lamp units 28*a*' to 33*a*' are arranged within the cylindrical retainer 205' with the broad rear surface of the base portions thereof radially outwardly, and the lamp portions thereof disposed radially inwardly as shown.

A generally star-shaped protector 224 for the modular lamp units is formed by a plurality of elongated elements 225 to 230 which are generally U-shaped in transverse section and are formed of resilient plastic sheet material. Each of the elements 225 to 230 comprises a pair of substantially identical, generally flat elongated rectangular wall portions disposed in spaced relation on opposite sides of the modular lamp unit protected thereby. The opposing wall portions of each such U-shaped element have their longitudinal inner marginal portions joined by a curved wall portion. More specifically, in FIG. 16, the element 226 protecting modular lamp unit 30*a*' has elongated rectangular walls 231 and 232, which are joined at their longitudinal inner marginal portions by an elongated rectangular wall 233 of the same material, which wall is curved in transverse section as shown. The outer marginal portions of the rectangular walls or panels 231 and 232 contact the inner surface of the cylindrical retainer 205' and at that point are joined to the outer extremities of the rectangular wall portions of the next adjacent U-shaped protective elements. The U-shaped-protectors for the other modular lamp units are the same as that for unit 30*a*' just described, and joinder of the adjacent protective U-shaped elements at their outer extremities, for example by fusion, forms the generally star-shaped protector 224.

Disposed coaxially within the cylindrical retainer 205' there is a normally cylindrical sleeve 234 formed of cushioning material, such as foam plastic. The outer diameter of sleeve 234 is sized to be somewhat compressed by contact with the curved inner wall portion 233 of the U-shaped element 226 and the corresponding wall portions of the other U-shaped elements, as shown. The bore of sleeve 234 is preferably sized to slidably receive a spare fluorescent lamp 235.

As was the case with the arrangement illustrated in FIG. 15, the arrangement in FIG. 16 also takes advantage of the strength of the base of each modular lamp unit which faces outwardly to absorb lateral blows in packaging or shipment. In combination with the generally star-shaped plastic sheet protector 224, the inwardly facing fluorescent lamps of the respective lamp units are both remote from the wall of cylindrical retainer 205' and are each enclosed within a protective shield formed by the resilient plastic U-shaped elements 225 to 230.

Figure 17:
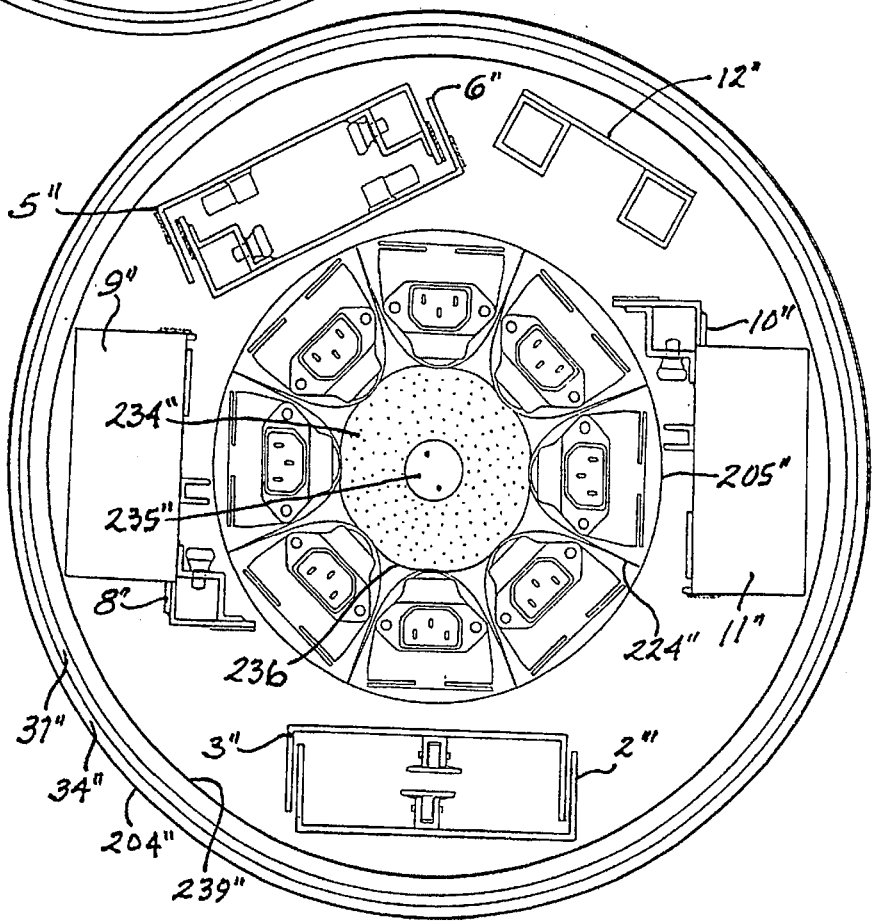
FIG. 17 is a view similar to FIGS. 15 and 16 showing all of the elements of an eight lamp unit backlit display of the present invention packed in a somewhat larger shipping container and in a somewhat different arrangement than that illustrated in FIGS. 15 and 16.

FIG. 17 illustrates a packing configuration for use in accommodating all of the disassembled major components of a backlit display of the present invention which utilizes eight modular lamp units, rather than the six shown in FIGS. 15 and 16. In FIG. 17, the elements indicated by the numerals with a double prime exponent (") are the same as the elements indicated by the same reference numerals in FIGS. 15 and 16, either without a suffix or with a prime exponent. Except for dimensional changes which will be discussed hereinafter, the major difference between FIGS. 16 and 17 involve the protector 224" which incorporates protective elements of U-shaped cross-section like the protective elements 225 to 230 in FIG. 16 associated with each of the eight modular lamp units illustrated, and, in addition, is provided with a cylindrical sleeve 236 formed of the same plastic sheet material as the element **224*b*. The sleeve 236 is contacted by each of the U-shaped elements forming the protector 224", as shown, and is preferably made integral therewith, as by plastic fusion. A sleeve 234" of cushioning material such as plastic foam, fits coaxially within the sleeve 236, the bore of said sleeve preferably being sized to accommodate a spare fluorescent lamp 235"**.

Because of their similar configuration, the structures illustrated in FIGS. 16 and 17 afford similar protection to the display components packaged therein.

Because of the differing arrangements and numbers of modular lamp units involved in FIGS. 15 to 17, the optimum dimensions for the various packing elements, differs somewhat. For example, in FIG. 15, the cylindrical container wall 204 may have an inner diameter of about 13 inches, and the cylindrical retainer 205 may have an inner diameter of about 6¼ inches. In FIG. 16, the cylindrical container wall 204' may have an inner diameter of about 13½ inches, and the cylindrical retainer 205' therein may have an inner diameter of about 7 inches. In FIG. 17, the cylindrical container wall 204" may have an inner diameter of about 14 inches, and the cylindrical retainer 205" may have an inner diameter of about 7¼ inches. The cylindrical sleeve 236 in FIG. 17 may have a diameter of about 2½ inches.

The axial length of the shipping containers 203, 203' and 203" varies with the length of the modular lamp units to be packed therein. Generally speaking, the axial length of cylindrical container walls 204, 204' and 204"; the elliptical packing sleeves 206, 207' and 208"; cylindrical retainers 205, 205' and 205"; and protectors 224 and 224", as well as cylindrical protector 239, should be about 4 inches longer than the lamps in the modular lamp units to be accommodated therein, which lamps may be 3, 4 or 5 feet in length.

The backlit display of the present invention is particularly well adapted to the needs of the do-it-yourself end user, because all of the assembly and disassembly steps involve simple hand operations, requiring no tools or fasteners and no particular level of mechanical skill. The display can be assembled by one person following the procedure which will now be described, in which procedure the hardware portions of the display are assembled face-down on a table.

The electrical power cords for interconnecting the wiring in the compartments 9 and 11 mentioned earlier herein are plugged into one another to electrically connect the ballasts therein which, in turn, supply power to all of the female connectors or sockets mounted on the lower horizontal frame member 7. The lower horizontal frame sections 8 and 10, and thereby the wiring compartments 9 and 11 integral therewith, respectively, are then slipped together in end-to-end alignment by introducing the channel-shaped member 161 (FIG. 5) projecting from the lower frame section 8 slidably into the tubular enclosure formed by the angle member 162, web 81 of the channel-shaped frame section 10 and front flange 24 of frame section 10.

As the frame sections approach each other, the member 161 approaches the pull pin 166 carried by the angle member 162. Pull pin 166 is retracted to allow the end of the member 161 to pass thereunder and is then released so that when the bore 168 in member 161 reaches the position thereof in FIG. 5, the pull pin 166 snaps into bore 168 to lock the frame sections 8 and 10, as well as compartments 9 and 11 in the assembled end-to-end abutting alignment shown in FIGS. 1, 2 and 5.

The vertical frame members 2 and 3 are then connected to the left and right-hand ends of the frame member 7. Since the structure at the right hand end of said frame member is the same as that at the left-hand end, the detailed assembly steps will be set forth for only the left-hand end, because the assembly steps for both are essentially the same.

More particularly, and with reference to FIGS. 12 and 13, the left-hand end of the frame member 7 is brought into right angular abutting relation with the frame member 2 in a position spaced from the upper ends of the locating pins 104 and 105 wherein the bores 111 and 115 in the left-hand ends of the angle members 108 and 112 are in substantial coaxial alignment with said locating pins. The pull pin 125 of the pull pin assembly 124 is then retracted into bore 123 in angle member 120, and the angle members 108 and 112 are moved toward contact with the horizontal flange 102 of the angle 100. During this movement, the bores 111 and 115 slidably and snugly receive or fit over the locating pins 104 and 105.

As the locating pins 104 and 105 enter bores 111 and 115, the pull pin 125 is released and moves into sliding contact with the right-hand surface of the vertical flange 118. Coincidentally with contact of the angle members 108 and 112 with the upper surface of the horizontal flange 102, the pull pin 125 snaps into the bore 119 in flange 118. This locks the joint very firmly by preventing any movement of the frame section 8 in the direction of the axes of the locating pins 104 and 105. The same assembly procedure is followed with respect to the connection of the right-hand end of the lower frame member 7 to the vertical frame member 3. The strut 15 (FIGS. 1, 2 and 3) is then released from its storage position pinned to clevis 183 on frame member 3. It is then swung down to the position shown in FIG. 2, wherein the pin 180, best shown in FIG. 3, is inserted through the clevis 175 and through the bore 174 of the eye fitting 173 at the free end of the strut 15. Strut 15, in the position illustrated in FIG. 2, provides rigidity for the lower right-hand corner of the frame 1. The strut 14 is then similarly released from a storage position pinned to the clevis 186 at the upper end of frame member 2, and is pinned into the clevis 185 in the same manner that strut 15 was pinned. Strut 14 supplies rigidity to the lower left-hand corner of frame 1 in the same manner that strut 15 does at the lower right-hand corner.

It has been found that, because of the thin silhoutte which the struts 14 and 15 present to the light flux directed at the display panel, no shadow is cast thereby on the display panel, nor is any other situation created which is undesirable or in any way detracts from the high and uniform luminance which is characteristic of the invention.

With reference to FIGS. 3 and 4, the sections 5 and 6 of the upper horizontal frame member 4 are then placed in end-to-end alignment, and are slipped together by introducing channel-shaped member 151 (FIG. 4) projecting from frame section 5 slidably into the tubular enclosure formed by the angle member 152, the web of frame section 6, and the front flange 22 of said frame section. As the frame sections 5 and 6 approach each other, the pull pin 156 is retracted into the bore 157 to allow the end of member 151 to pass thereunder, and is then released, so that when bore 158 in member 151 reaches the position shown in FIG. 4, the pull pin 156 snaps into said bore to lock the frame sections 5 and 6 in the assembled, end-to-end abutting alignment shown in FIGS. 1, 2 and 4.

The opposite ends of the now assembled frame member 4 are then joined to the upper ends of the side frame members 2 and 3 as follows. Referring to FIG. 14, the flanges 20 and 21 of the channel-shaped frame member 4 are brought into alignment and contact with flanges 16 and 17 of the frame member 2 with the rectangular tongue 136 offset outwardly from the outer surface of member 139 on frame 2, so that the locating pin 138, and the corresponding locating pin (not shown) are aligned with the bore 43 and the corresponding bore (not shown) in the web portion of member 140. The pull pin 149 is then retracted into the bore 147 of the flange 146 to permit axial movement of the locating pin 138 and its counterpart (not shown) toward the bore 143 and its counterpart (not shown) in member 139.

As the flange 146 engages the outer surface of the flange 142 and the pull pin 149 reaches a position opposite said flange, the pull pin is released into sliding engagement with flange 142. When the bore 147 becomes coaxial with the bore 150, it snaps into the bore 150 as the rectangular tongue 136 which carries the locating pin 137 and its counterpart (not shown) moves into laminate contact with the outer surface of the web 140 of channel member 139. By movement of the locating pin 138 and its counterpart into the bore 143 and its counterpart, respectively, the frame members 2 and 4 are rigidly joined in the right angular relationship shown in FIG. 14 and are locked in that relationship by the pull pin 149. The right-hand end of the frame member 4 is rigidly joined to the outer end of the vertical frame member 3 in the same manner as has been described with respect to joinder of the left-hand end of frame member 4 with the side frame member 2.

Each of the modular lamp units 28 to 33 or 28*a* to 33*a* is then installed on the frame 1 by plugging the male connector 70 or 70*a* of each thereof into one of the six female electrical connectors carried by lower horizontal frame member 7. The male and female electrical connectors are polarized, i.e., insertion of the male connector into the female can be accomplished in the orientation shown in FIG. 3 only. This insures that the masks 99 on the fluorescent lamps face the display panel 34, with the longitudinal axis of the masks on each lamp located in a vertical plane normal to the display panel 34 and which also includes the axis of the respective lamp.

Following introduction of the male connector of a given modular lamp unit into a female connector, the upper end thereof is swung forwardly to introduce the horizontal arm 49 or 49*a* of bracket 48 or 48*a* through one of the notches 187 in a rear flange of frame sections 5 or 6. This moves the cylindrical latch pin 50 or 50*a* of the lamp unit into latched position between the resilient arms 51 of the latch 52 to secure the respective lamp unit in the operative position shown in FIG. 3.

As shown in phantom lines in FIG. 6, when the modular lamp unit reaches the operative position shown in FIG. 3, the upper corners of the vertical portion of bracket member 48 overlap portions of the rear flange of the frame member 5 or 6 on opposite sides of the respective notch 187. The shape and spring action of the arms 51 of the latch 52 are such that in order for a latch pin to enter between the spaced arms of latch 52 and move to the operative position shown in FIG. 3, the pin must move inwardly past a point (not shown) where the arms are spaced apart a distance less than the diameter of the pin.

In so moving, the latch pin spreads such arms apart against the normal resistance thereof to deformation. Once the pin moves past that point, the biasing action of the arms seeking to return to their undeformed state, retains the pin in operative position by exerting a forward bias thereon, which bias holds the bracket 48 in contact with the related flange, such as flange 23, shown in FIG. 3 and shown in phantom lines in FIG. 6.

It is apparent that when a given modular lamp unit is in the operative position shown in FIG. 3, the rear surface 47 of the elongated body member 41 thereof and the vertical extents of the brackets 48 and 60 of said lamp unit are substantially coplanar with the rear surface of the rear flanges of the frame 1.

If the modular lamp units installed in the frame 1 are the units 28 to 33 shown in FIGS. 1, 3, 6 and 7, the rear wall 37 of the display comprises a single rectangular extent of rollable, diffusely and substantially nonspecularly reflective white plastic or fabric material having loop type connector strips bound to the marginal portions thereof.

The rear wall member 37 is unrolled and placed in registration with the hook strips 39 on the back flanges of the assembled frame 1. The back wall 37, as thus applied to the frame 1, extends in contact with the coplanar rear surfaces 47 of the respective modular lamp units installed in said frame. If desired, the rear wall 37 may also be releasably bound to the rear surfaces 47 of the modular lamp units by cooperable hook and loop connectors bound to said rear wall and to said lamp unit rear surface respectively.

The footing 13 is then installed at the lower end of the vertical frame member 2. With reference to FIG. 13, this is done by inserting the upper tubular box member 131 and the upper portion of the plate 132 into the rear end of the space therefor shown in FIG. 13. The cylindrical pull pin 125 is retracted sufficiently to permit such insertion, and when a portion of the plate 132 moves past the bore 133, the pull pin 125 is released and is biased into contact with the adjacent surface of the plate 132. When the bore 133 in plate 132 moves into coaxial relation with the coaxial bores 119 and 133, the pull pin 125 snaps into bore 133 as the tubular box member 131 contacts the rear surface of the front flange 16 at the lower end of frame member 2.

With the pin 125 in the bore 133, the footing 13 is effectively locked to the frame 1. The footing 12 is then installed at the base of the vertical frame member 3 in the same manner, since it is of construction similar to the footing 13.

It is understood, of course, that the invention is not limited to free standing backlit displays, because it is equally well adapted for wall mounted application. Such applications includes, for example, those wherein large format transparencies and other graphics used in galleries, museums and elsewhere are to be illuminated by back lighting and may not require frequent disassembly and reassembly.

If the modular lamp units installed in the frame 1 are not the units 28 to 33, but are rather units 28*a* to 33*a*, shown in FIGS. 2, 9, 10 and 11, the unitary back wall member 37 may be, but preferably is not, used. Rather, the rear wall member 37 is replaced by the elongated rectangular rear wall sections or panels 196 to 202. The panels 197 to 201 are of a uniform width, preferably of slightly more than 9 inches, whereas the end panels 196 and 202 have a uniform width of preferably slightly more than 4 inches.

Each of the modular lamp units 28*a* to 33*a* is of the same construction as that illustrated in FIGS. 2, 9, 10 and 11, and has opposite laterally outwardly directed slots 190 and 191. When the lamp units 28*a* to 33*a*, are in operative position, one of the panels 197 to 201 is disposed between each adjacent pair of said units. Each of said panels has one of its longitudinal marginal portions disposed within the slot 191 of one of an adjacent pair of lamp units, and its other longitudinal marginal portion disposed in the longitudinal slot 190 of the other lamp unit of said pair.

The transverse dimension of slots 190 and 191 in the modular lamp unit base members, as shown in FIGS. 9 and 10, are significantly greater than the thickness of the rear wall panels 196 to 202. Thus, said panels readily slide within said slots. Moreover, they can be introduced into said slots from either end thereof, i.e., at the points 192 or 193 in FIG. 10.

The panels 197 to 201 are preferably held in the operative position shown in FIGS. 2 and 9 by the releasable connection means (not shown) described earlier herein which attaches the upper end of each panel to the adjacent rear flange 21 of the upper horizontal frame sections 5 and 6. Such connection means prevents downward gravitational movement of the panels from their operative positions.

The outer elongated panels 196 and 202 are retained in their operative position somewhat differently. End panel 196 may have its right longitudinal marginal portion disposed within the outwardly facing slot 191 of the modular lamp unit 28*a*. It may also have its left or outer longitudinal marginal portion secured to the rear surface of rear flange 17 of the left vertical frame 2 by the same type of hook and loop connector means as that used to attach the rear wall 37 to said flange member in the form of the invention shown in FIGS. 1, 3, 6 and 7.

The elongated rectangular end panel 202 may have its left longitudinal marginal portion disposed within the outwardly facing slot 190 of the modular lamp unit 33*a*. It may also have its right or outer longitudinal marginal portion releasably secured to the rear surface of the rear flange 19 of right vertical frame member 3 by the same type of hook and loop connector means as that used to attach the rear wall 37 to said flange in the form of the invention shown in FIGS. 1, 3, 6 and 7.

The thus far assembled display is then stood erect on the footings 12 and 13, and the unrolled display panel 34 is attached to the front surfaces of the front flanges of the frame 1, beginning with the hook and loop type connectors along the front flanges 20 and 22 of the upper horizontal frame sections 5 and 6. The vertical left and right-hand margins of the display panel 34 are then attached to the front faces of the front flanges 16 and 18 of the vertical frame members 2 and 3, respectively, after which the lower horizontal margin of said display panel is attached by the hook and loop connectors to the front faces of the flanges 24 and 26 of the lower frame sections 8 and 10, respectively. The backlit display of the invention is then ready for use upon plugging the external power cord (not shown) into an appropriate source of power.

Disassembly of the display of the present invention can be accomplished by undertaking the reverse order of the assembly steps. Release of each locked joint is effected by simply retracting the locking pull pin therein manually and without the need for any tools. Following disassembly, the individual major components are then packed in the appropriate cylindrical shipping container as illustrated in one of FIGS. 15 to 17.

The compactness with which the component parts of the display of the present invention can be packed in the manner shown in FIGS. 15 to 17 is much more space efficient than the packing of prior art backlit displays. For example the backlit display shown in my copending application Ser. No. 08/014,809, now U.S. Pat. No. 5,461,808, filed Feb. 8, 1993, when assembled, occupies a volume of about 7.4 cubic feet, and is packable in two shipping containers having a total volume of 9.92 cubic feet. This provides a ratio of packed volume to assembled volume of 134 percent. At the time the noted patent application was filed, the 134 percent ratio was very low. However the present invention, in contrast, provides a ratio of packed volume to assembled volume of less than 50 percent.

Various changes and modifications may be made without departing from the spirit of the invention. For example, welding is stated herein as a means for fastening various elements together. However, a number of satisfactory alternative fastening means well known in the art may be used instead welding, wherever such alternative is deemed better for the particular application under consideration. All of such changes are contemplated as may come within the scope of the appended claims.

I claim:

1. A backlit display comprising, in combination, a frame formed of opposing horizontal and vertical frame members and generally coplanar front surfaces defining a rectangular front opening, said frame also having generally coplanar rear surfaces spaced from said front surfaces and defining a rectangular rear opening; a light transmissive display panel extending across said frame front opening; a first electrical connector carried by one of said frame members; at least one modular lamp unit comprising an elongated base member having an elongated tubular body portion with a generally triangular cross-section, said base member having at one end a second electrical connector adapted to removably engage said first electrical connector, a cylindrical fluorescent lamp mounted on said elongated base member; releasable latch means on the other end of said base member and on the frame member opposite that which carries said first electrical connector, said modular lamp unit having an operative position in which the axis of said lamp is generally parallel with said frame front surfaces, in which position said electrical connectors are engaged and said latching means are also engaged to thereby releasably retain said lamp unit in said operative position; and a rear wall comprising at least one generally planar panel having a substantially nonspecular diffusely light reflective front surface generally coplanar with said frame rear surfaces.

2. The combination of claim 1 wherein there is light leveling masking on the surface portion of said fluorescent lamp facing said display panel when said modular lamp unit is in its operative position, said masking means having a longitudinal axis in a plane normal to said display panel and which includes the axis of said lamp.

3. The combination of claim 2 wherein said first and second electrical connectors are polarized to permit connective engagement thereof only in an orientation which corresponds to said operative position of the modular lamp unit.

4. The combination of claim 1 wherein said elongated tubular body portion has two divergent wall portions each having an elongated rectangular generally planar reflective outer surface which is joined to that of the other wall portion at a vertex spaced from said lamp and located in a plane normal to said display panel, which plane also includes the axis of said lamp, said reflective surfaces being substantially equiangularly divergent in a rearward direction with respect to said plane and having rear marginal portions adjacent said rear wall, said reflective surfaces being effective when said modular lamp unit is in its operative position to reflect rearwardly directed light flux from said lamp laterally outwardly and rearwardly to locations on said rear wall from which portions of said light flux are diffusely reflected forwardly toward areas of said display panel directly in front of said lamp.

5. The combination of claim 1 wherein said frame members are readily releasably but rigidly locked at the corners of said frame, and each of a pair of opposing frame members is formed in sections which are provided with cooperable means for releasably locking said frame sections in aligned abutting end-to-end relation.

6. The combination of claim 1 wherein said rear wall is a rectangular panel of rollable material extending across said frame rear opening.

7. The combination of claim 6 wherein the base member of said at least one modular lamp unit has a generally planar rear surface generally coplanar with said rear wall.

8. The combination of claim 1 wherein there are at least two of said modular lamp units in substantially parallel relation, the elongated base member of each of said modular units being formed with laterally oppositely outwardly facing rectilinear longitudinal grooves; and said rear wall is formed of at least one elongated generally planar rectangular panel having opposite longitudinal marginal portions removably disposed within facing grooves of said two modular lamp units.

9. The combination of claim 4 wherein there is a plurality of said modular lamp units in substantially equally spaced parallel relation.

10. The combination of claim 9 wherein the elongated base member of each of said modular lamp units is formed adjacent the longitudinal rear margins of said reflective surfaces thereof with rectilinear longitudinal oppositely laterally outwardly facing grooves, and said rear wall is formed of a plurality of generally coplanar rectangular panels, at least some of which have opposite longitudinal marginal portions removably disposed within facing rectilinear longitudinal grooves of adjacent modular lamp units.

11. In combination, an elongated base member having an electrical connector fixed to one end thereof; a cylindrical fluorescent lamp mounted on said base member and connected in electrical circuit with said electrical connector; and shoulder means on the other end of said base member, said electrical connector being adapted for connection with a supporting connector, and said shoulder means being adapted for releasable engagement with supporting latch beads.

12. The combination of claim 11 wherein said elongated base member is formed with an elongated generally planar rear surface on the side thereof opposite said lamp.

13. The combination of claim 12 wherein there is light leveling masking means on the surface portion of said fluorescent lamp facing away from said rear surface, said masking means having a longitudinal axis in a plane normal to said rear surface, which plane also includes the axis of said lamp.

14. The combination of claim 12 wherein said elongated base member is formed on the side thereof opposite said rear surface with a pair of rectangular elongated generally planar reflective surface portions which are joined at a vertex spaced from said lamp and located in a plane normal to said rear surface, which plane includes the axis of said lamp, said reflective surfaces being substantially equiangularly divergent in a rearward direction with respect to said plane and having elongated rear marginal portions adjacent the longitudinal marginal portions of said rear surface.

15. The combination of claim 14 wherein said reflective surfaces form an angle of about 90 degrees.

16. The combination of claim 11 which is generally triangular in end view, said elongated base member having a rear surface whose width is of the order of about 2.36 times the diameter of said lamp.

17. The combination of claim 11 wherein said elongated base member is formed with laterally oppositely outwardly facing elongated grooves.

18. The combination of claim 11 wherein said base member is formed with longitudinal passage means therein, and said electrical connector is connected in circuit with both ends of said lamp by wiring, at least a portion of which extends within said passage means.

19. The combination of claim 18 wherein said elongated base member includes a tubular portion which has a generally triangular cross section.

20. The combination of claim 11 which also includes a frame having a opposing horizontal and vertical frame members, one of which members has fixed thereto a second electrical connector, and the opposing one of which has latch means mounted thereon, said base member shoulder means being adapted for coaction with said latch means, the electrical connector on said base member being capable of interfitting connection with said second electrical connector, whereby said modular lamp unit is mountable on said frame by interconnection of said first mentioned and second electrical connectors and engagement of said shoulder means with said latching means.

21. The combination of claim 20 wherein said base member has second shoulder means adapted for abutment with the frame member to which said latching means is fixed when said first-mentioned shoulder means is engaged with said latching means.

22. A backlit display comprising in combination a rectangular frame having front and rear sides and formed of opposing horizontal and vertical frame members releasably joined at their ends to form corners of said frame; a plurality of modular lamp units each comprising an elongated base member on which is mounted a cylindrical fluorescent lamp, said base members each being releasably connected at its opposite ends, respectively, to opposing frame members with the lamps thereof in substantially equal spaced parallel relation and facing the front of said frame; a generally planar rectangular light transmissive display panel on the front of said frame in substantial registration therewith; and a generally planar rear wall on the rear side of said frame and in substantial registration therewith, said rear wall having a diffusively reflective substantially nonspecular surface facing the display panel, said lamp unit base members each having a generally planar rear surface generally coplanar with said rear wall.

23. The combination of claim 22 wherein each of two opposing frame members has a strut member pivotally connected at one end to an intermediate portion thereof, said strut members each being swingable between a storage position parallel with the frame member to which it is pivotally connected and an operative position in which the free end thereof is readily releasably connected to an intermediate portion of a next adjacent frame member to thereby form a rigidifying triangle with the two frame members to which it is connected in said operative position.

24. The combination of claim 22 wherein the releasable frame corner joints each comprise right angle flange portions on each of the frame members joined thereat, said flange portions extending respectively parallel with and transverse to the length of the respective frame members, said right angle flange portions of one frame member being in overlapping relation with respect to those of the adjacent frame member, one of a pair of overlapping flange portions being formed with a first bore, and the other having fixed thereto a locating pin which is coaxially seated in said first bore, one of the other pair of overlapping flange portions being formed with a second bore, and the flange portion in overlapping relation therewith carries a spring loaded pull pin coaxially slidably seated within said second bore, withdrawal of said pull pin from said second bore against the bias of said spring loading permitting withdrawal of the locator pin from said first bore and separation of said adjacent frame members.

25. The combination of claim 22 wherein said display panel and rear wall are made of rollable material.

26. The combination of claim 22 wherein said vertical frame members extend below said frame, and a footing member is readily removably fixed to the lower end of each of said vertical frame members.

27. The backlit display of claim 25 wherein the horizontal frame members are formed in sections which are provided with means releasably locking the sections thereof in aligned abutting end-to-end relation; and when said display is disassembled, all parts thereof can be accommodated within a container whose dimensions are within the limits acceptable for shipment by commercial parcel deliver services.

28. The combination of claim 22 wherein the releasable connection at one end of each of said modular lamp units is a plug in type electrical connector cooperable with a complementary electrical connector carried by a lower horizontal frame member.

29. The combination of claim 28 wherein all of the electrical circuitry for the display not included in the modular lamp units is contained in compartment means attached to said lower horizontal frame member.

30. In combination, an elongated tubular cylindrical retainer; a plurality of modular lamp units each comprising an elongated generally rectilinear base member having laterally projecting lamp receptacles adjacent the ends thereof; a cylindrical fluorescent lamp mounted in and extending between said lamp receptacles of each lamp unit in spaced generally parallel relation with said base member thereof, each said base member having an elongated generally flat rear surface opposite said lamp receptacles and a generally triangular shape in end view which tapers from said rear surface toward said lamp receptacles, said lamp units being disposed longitudinally within said cylindrical retainer in generally equally spaced relation with the lamps thereof innermost and said rear surfaces radially outward therefrom and adjacent the inner surface of said cylindrical retainer; resilient protective means for said lamp units comprising a plurality of elongated resilient protectors of generally U-shaped cross section each having a pair of elongated generally rectangular walls on opposite sides of one of said modular lamp units, said walls being joined along their inner margins by a wall portion of curved cross section from which said walls extend generally radially outwardly within said cylindrical retainer, said rectangular wall portions of each protector having outer marginal portions joined to outer marginal portions of the adjacent wall portion of the next adjacent protectors, which joined portions are in substantial contact with inner surface of said cylindrical retainer.

31. The combination of claim 30 wherein there is an elongated generally cylindrically shaped cushion member disposed coaxially within said cylindrical retainer and with which said inner curved wall portions of the respective protectors are in contact.

32. The combination of claim 31 wherein said cushion member is a generally cylindrical sleeve having an axial bore within which a spare one of said fluorescent lamps can be coaxially accommodated.

33. The combination of claim 30 wherein there are six of said modular lamp units, and said cylindrical retainer has a diameter of about 7 inches and a length of from about 40 inches to about 64 inches.

34. The combination of claim 30 wherein there are 8 of said lamp units, said cylindrical retainer has a diameter of about 7½ inches, and there is a cylindrical tubular member disposed coaxially within said cylindrical retainer and with which the curved wall portions of each of said protectors is in contact, said cylindrical tubular member having a diameter of about 2½ inches.

35. The combination of claim 30 which further comprises a shipping container having an elongated cylindrical wall within which said cylindrical retainer is coaxially disposed in spaced relation to define an annular chamber surrounding said cylindrical retainer within said cylindrical wall; a rolled light transmissive display panel and rolled diffusely reflective rear wall means, both for a backlit display, disposed in overlaying relation with the inner surface of said cylindrical container wall, and a plurality of backlit display frame members disposed longitudinally within said annular chamber, said frame members, modular lamp units, display panel and rear wall means being assemblable into a backlit display.

36. The combination of claim 35 in which said backlit display, when assembled, occupies a volume more than twice that of said shipping container.

37. The combination of claim 35 wherein there is a cylindrical protector of resilient sheet material disposed in spaced coaxial relation in said annular chamber between said frame members and said rolled display panel and rear wall means.

38. The combination of claim 35 wherein there are six of said modular lamp units, said cylindrical retainer has a diameter of about 7 inches, and said shipping container cylindrical wall has an internal diameter of about 13½ inches.

39. The combination of claim 35 wherein there are eight of said modular lamp units, said cylindrical retainer has a diameter of about 7½ inches, there is a cylindrical tubular member disposed coaxially within said cylindrical retainer and with which the curved wall portion of each of said protectors is in contact, and said shipping container cylindrical wall has an internal diameter of about 14 inches.

40. In combination, a pair of like modular lamp units each comprising an elongated rectilinear base member having laterally projecting fluorescent receptacles adjacent the ends thereof; a cylindrical fluorescent lamp mounted in and extending between the receptacles of each said modular lamp unit in spaced generally parallel relation with said base member thereof, each said base member having an elongated generally flat rear surface opposite said lamp receptacles and a generally triangular shape in end view which tapers from the longitudinal margins of said rear surface toward said lamp receptacles; and an elongated resilient plastic packing tube of generally ellipitical cross-section, said pair of modular lamp units, with the rear surfaces thereof in registration, extending longitudinally and snugly within said packing tube.

41. The combination of claim 40 wherein said elliptical resilient plastic packing tube in its unstressed state is generally cylindrical and has a diameter causing said tube to assume said elliptical cross-sectional shape on introduction thereinto of said pair of modular lamp units.

42. The combination of claim 40 which further comprises an elongated tubular cylindrical retainer within which three of said packing tubes, each having a pair of said modular lamp units enclosed therein as described, are accommodated longitudinally, said cylindrical retainer having a diameter to accommodate therein said three elliptical packing tubes in an orientation in which spaced longitudinal portions of one elongated sidewall portion of the elliptical cross-section of each of said tubes is juxtaposed to the inner surface of said cylindrical retainer, and spaced longitudinal portions of the other elongated side wall portion of said elliptical cross section of each packing tube, respectively, are juxtaposed to corresponding portions of each of the other two packing tubes in said retainer.

43. The combination of claim 42 which further comprises a shipping container having a cylindrical wall within which said cylindrical retainer is disposed in coaxially spaced relation to define an annular chamber surrounding said cylindrical retainer within said cylindrical container wall; a rolled light transmissive display panel and rolled diffusely reflective rear wall means, both for a backlit display, disposed in overlaying relation with the inner surface of said cylindrical shipping container wall, and a plurality of backlit display frame members disposed longitudinally within said annular chamber, said frame member, modular lamp units, display panel and rear wall means being assemblable into a backlit display.

44. The combination of claim 43 in which said backlit display, when assembled, occupies a volume of more than twice that of said shipping container.

45. The combination of claim 43 wherein there is a cylindrical protector of resilient sheet material disposed in spaced coaxial relation in said annular chamber between said frame members and said rolled display panel and rear wall means.

46. In combination, a modular lamp unit comprising an elongated generally rectilinear rigid base member having an electrical connector at one end thereof and shoulder means at the other end thereof; a fluorescent lamp receptacle projecting laterally from each end of said base member; a cylindrical fluorescent lamp disposed in parallel relation with said base member and having its opposite ends respectively mounted in said lamp receptacles; and an electrical circuit connected to both of said lamp receptacles and said electrical connector; first and second spaced supports; and releasable connection means respectively cooperable with said shoulder means and said electrical connector for attaching said base member end portions, respectively, to said supports.

47. The combination of claim 46 wherein said base member is tubular; a first portion of said electrical circuit extends within said tubular base member from said electrical connector to said lamp receptacle at the opposite end of said base member; and a second portion of said electrical circuit extends from said electrical connector to said lamp receptacle adjacent thereto.

* * * * *